US009399350B2

(12) United States Patent
Kimura et al.

(10) Patent No.: US 9,399,350 B2
(45) Date of Patent: Jul. 26, 2016

(54) LIQUID EJECTING SYSTEM, LIQUID EJECTING APPARATUS, AND CONTAINING UNIT

(71) Applicant: SEIKO EPSON CORPORATION, Tokyo (JP)

(72) Inventors: Naomi Kimura, Nagano (JP); Shoma Kudo, Nagano (JP); Hidenao Suzuki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 4 days.

(21) Appl. No.: 14/597,502

(22) Filed: Jan. 15, 2015

(65) Prior Publication Data

US 2015/0197095 A1 Jul. 16, 2015

(30) Foreign Application Priority Data

Jan. 16, 2014 (JP) ..... 2014-005698

(51) Int. Cl.
*B41J 2/175* (2006.01)

(52) U.S. Cl.
CPC ..... *B41J 2/17523* (2013.01); *B41J 2/17553* (2013.01); *B41J 2/17503* (2013.01)

(58) Field of Classification Search
CPC .... B41J 2/175; B41J 2/17513; B41J 2/17509; B41J 2/17596; B41J 2/17553
USPC ..... 347/85
See application file for complete search history.

(56) References Cited

U.S. PATENT DOCUMENTS

2012/0050359 A1* 3/2012 Koganehira ..... B41J 2/17509 347/6
2012/0182364 A1 7/2012 Takeda et al.
2014/0035537 A1* 2/2014 Hong ..... B60L 3/0046 320/162
2014/0043408 A1* 2/2014 Kudo ..... B41J 2/17556 347/86

FOREIGN PATENT DOCUMENTS

JP 2012-051327 A 3/2012
JP 2012-144016 A 8/2012

* cited by examiner

*Primary Examiner* — Manish S Shah
*Assistant Examiner* — Yaovi M Ameh
(74) *Attorney, Agent, or Firm* — Global IP Counselors, LLP

(57) ABSTRACT

A liquid ejecting system includes a liquid ejecting apparatus, a containing unit configured to contain a liquid, and a liquid supply tube configured to supply the liquid from the containing unit to the liquid ejecting apparatus. The liquid ejecting apparatus includes a first casing and a second casing that opposes the first casing. The containing unit includes a third casing and a fourth casing that opposes the third casing. The first casing has a first penetration hole. The second casing has a second penetration hole that overlaps with the first penetration hole. The fourth casing has a first protruding section. The containing unit is fixed to the liquid ejecting apparatus in a state where the first protruding section is inserted into the first penetration hole and the second penetration hole.

5 Claims, 19 Drawing Sheets

LIQUID EJECTING SYSTEM, LIQUID EJECTING APPARATUS, AND CONTAINING UNIT

CROSS-REFERENCE TO RELATED APPLICATIONS

This application claims priority to Japanese Patent Application No. 2014-005698 filed on Jan. 16, 2014. The entire disclosure of Japanese Patent Application No. 2014-005698 is hereby incorporated herein by reference.

BACKGROUND

1. Technical Field

The present invention relates to a technique where a containing unit, which accommodates a vessel which contains a liquid, is fixed in a liquid ejecting apparatus.

2. Related Art

There are liquid ejecting systems in use which are provided with a liquid ejecting apparatus, which is provided with a liquid ejecting section which ejects ink and the like, and a containing unit which accommodates a vessel which supplies a liquid to the liquid ejecting section. An example of this type of liquid ejecting apparatus is disclosed in JP-A-2012-051327 (PTL 1). The containing unit which accommodates an ink containing vessel is attached to a side surface of the printer which is an example of the liquid ejecting apparatus in PTL 1. The printer in PTL 1 is an ink jet printer which is provided with an ink jet head which is an example of the liquid ejecting section which ejects ink.

SUMMARY

A simple configuration where a hook in the containing unit catches with a catching section on the side surface of the printer is adopted as a structure for attaching the containing unit to the printer in PTL 1. However, there is a concern with this structure that it will be easy for the hook to be separated from the catching section and the containing unit will be separated from the printer when the entire system of the liquid ejecting system which is formed from the printer and the containing unit is lifted up such as during transporting.

The present invention is carried out in order to solve this problem and has an aspect of proposing a technique where a containing unit which accommodates a vessel which contains a liquid is fixed so as to not be easily separated from a liquid ejecting apparatus.

In order to solve the problem described above, a liquid ejecting system of the present invention is provided with a liquid ejecting apparatus, a containing unit configured to contain a liquid, and a liquid supply tube configured to supply the liquid from the containing unit to the liquid ejecting apparatus, the liquid ejecting apparatus includes a first casing, a second casing that opposes the first casing, and a liquid ejecting head that is positioned between the first casing and the second casing and is configured to eject the liquid, the containing unit includes a third casing that has an upper wall section facing in a vertically upward direction in a state where the liquid ejecting apparatus is being used, a fourth casing that opposes the third casing, and a liquid containing vessel that is positioned between the third casing and the fourth casing and is configured to contain the liquid, the first casing has a first penetration hole, the second casing has a second penetration hole that overlaps with the first penetration hole, the fourth casing has a first protruding section, and the containing unit is fixed to the liquid ejecting apparatus in a state where the first protruding section is inserted into the first penetration hole and the second penetration hole.

According to the present invention, the first protruding section of the fourth casing is fixed in a state of penetrating through both the first casing and the second casing. Due to this, it is possible to increase the fixing strength in a direction which intersects with a penetrating direction. Accordingly, there is little concern that the containing unit will be easily separated from the liquid ejecting apparatus and it is possible to increase the fixing strength compared with in the past. As such, stable carrying is possible without either being separated when carrying.

In the present embodiment, it is desirable that the first casing have a third penetration hole, the second casing have a fourth penetration hole that overlaps with the third penetration hole, the fourth casing have a second protruding section, and the containing unit be fixed to the liquid ejecting apparatus in a state where the second protruding section is inserted into the third penetration hole and the fourth penetration hole. By doing this, since the second protruding section of the fourth casing penetrates through both the first casing and the second casing, the containing vessel is fixed in a state where both of the two protruding sections pass through both of the first casing and the second casing. Accordingly, the fixing strength of the containing unit with regard to the liquid ejecting apparatus is further increased and stability is further improved.

In the present embodiment, it is desirable that the fourth casing have a third protruding section and the containing unit is fixed to the liquid ejecting apparatus in a state where the third protruding section and the first casing interpose the second casing. By doing this, the fixing strength of the containing unit with regard to the liquid ejecting apparatus is further increased and stability is further improved.

Next, a liquid ejecting system of the present invention is provided with a liquid ejecting apparatus, a containing unit configured to contain a liquid, and a liquid supply tube configured to supply the liquid from the containing unit to the liquid ejecting apparatus, the liquid ejecting apparatus includes a first casing, a second casing that opposes the first casing, and a liquid ejecting head that is positioned between the first casing and the second casing and is configured to eject the liquid, the containing unit includes a third casing that has an upper wall section facing in a vertically upward direction in a state where the liquid ejecting apparatus is being used, a fourth casing that opposes the third casing, and a liquid containing vessel that is positioned between the third casing and the fourth casing and is configured to contain the liquid, the first casing has a first penetration hole, the second casing has a second penetration hole, the fourth casing has a first protruding section and a second protruding section, and the containing unit is fixed to the liquid ejecting apparatus in a state where the first protruding section is inserted into the first penetration hole and the second protruding section is inserted into the second penetration hole.

According to the present invention, the first protruding section and the second protruding section of the fourth casing are fixed in a state of respectively penetrating through the first casing and the second casing. Due to this, it is possible to increase the fixing strength in a direction which intersects with a penetrating direction. Accordingly, there is little concern that the containing unit will be easily separated from the liquid ejecting apparatus and it is possible to increase the fixing strength compared with in the past. As such, stable carrying is possible without either being separated when carrying.

Next, a liquid ejecting system of the present invention is provided with a liquid ejecting apparatus, a containing unit configured to contain a liquid, and a liquid supply tube configured to supply the liquid from the containing unit to the liquid ejecting apparatus, the liquid ejecting apparatus includes a first casing, a second casing that opposes the first casing, and a liquid ejecting head that is positioned between the first casing and the second casing and is configured to eject the liquid, the containing unit includes a third casing that has an upper wall section facing in a vertically upward direction in a state where the liquid ejecting apparatus is being used, a fourth casing that opposes the third casing, and a liquid containing vessel that is positioned between the third casing and the fourth casing and is configured to contain the liquid, the first casing has a first penetration hole, the second casing has a second penetration hole that overlaps with the first penetration hole, the third casing has a first protruding section, and the containing unit is fixed to the liquid ejecting apparatus in a state where the first protruding section is inserted into the first penetration hole and the second penetration hole.

According to the present invention, the first protruding section of the third casing is fixed in a state of penetrating through both the first casing and the second casing. Due to this, it is possible to increase the fixing strength in a direction which intersects with a penetrating direction. Accordingly, there is little concern that the containing unit will be easily separated from the liquid ejecting apparatus and it is possible to increase the fixing strength compared with in the past. As such, stable carrying is possible without either being separated when carrying.

In the present embodiment, it is desirable that the first casing have a third penetration hole, the second casing have a fourth penetration hole that overlaps with the third penetration hole, the third casing have a second protruding section, and the containing unit be fixed to the liquid ejecting apparatus in a state where the second protruding section is inserted into the third penetration hole and the fourth penetration hole. By doing this, since the second protruding section of the third casing penetrates through both the first casing and the second casing, the containing vessel is fixed in a state where both of the two protruding sections pass through both of the first casing and the second casing. Accordingly, the fixing strength of the containing unit with regard to the liquid ejecting apparatus is further increased and stability is further improved.

Next, a liquid ejecting system of the present invention is provided with a liquid ejecting apparatus, a containing unit configured to contain a liquid, and a liquid supply tube configured to supply the liquid from the containing unit to the liquid ejecting apparatus, the liquid ejecting apparatus includes a first casing, a second casing that opposes the first casing, and a liquid ejecting head that is positioned between the first casing and the second casing and is configured to eject the liquid, the containing unit includes a third casing that has an upper wall section facing in a vertically upward direction in a state where the liquid ejecting apparatus is being used, a fourth casing that opposes the third casing, and a liquid containing vessel that is positioned between the third casing and the fourth casing and is configured to contain the liquid, the first casing has a first penetration hole, the second casing has a second penetration hole, the third casing has a first protruding section and a second protruding section, and the containing unit is fixed to the liquid ejecting apparatus in a state where the first protruding section is inserted into the first penetration hole and the second protruding section is inserted into the second penetration hole.

According to the present invention, the first protruding section and the second protruding section of the third casing are fixed in a state of respectively penetrating through the first casing and the second casing. Due to this, it is possible to increase the fixing strength in a direction which intersects with a penetrating direction. Accordingly, there is little concern that the containing unit will be easily separated from the liquid ejecting apparatus and it is possible to increase the fixing strength compared with in the past. As such, stable carrying is possible without either being separated when carrying.

In the present invention, it is desirable that there be further provided at least one of a first fixing member that fixes the first casing and the third casing and a second fixing member that fixes the second casing and the fourth casing. By doing this, the fixing strength is further increased and stability is improved since the locations for fixing is further increased. In a case where screw members are used as the first and the second fixing member, it is possible to improve the fixing strength in a screwing direction.

In the present invention, a configuration is possible where the first casing includes a scanner unit.

Next, the present invention is a liquid ejecting apparatus that is provided with a liquid ejecting section, a containing section configured to contain a liquid, and a liquid supply tube configured to supply the liquid from the containing section to the liquid ejecting section, the liquid ejecting section includes a first casing, a first region of a second casing that opposes the first casing and that is used as a casing member on a bottom surface side of the liquid ejecting apparatus in a state where the liquid ejecting apparatus is being used, and a liquid ejecting head that is positioned between the first casing and the first region of the second casing and is configured to eject the liquid, and the containing section includes a third casing, a second region of the second casing that opposes the third casing, and a liquid containing vessel that is positioned between the third casing and the second region of the second casing and is configured to contain the liquid.

According to the present invention, since the second casing is shared by the liquid ejecting section and the containing section, there is no separating of the liquid ejecting section and the containing section when being carried by the second casing being grasped. Accordingly, stable carrying is possible. Furthermore, a removing operation is easy since it is sufficient for just the third casing to be removed when there is a desire to remove the containing section.

Next, the present invention is a liquid ejecting apparatus that is provided with a liquid ejecting section, a containing section configured to contain a liquid, and a liquid supply tube configured to supply the liquid from the containing section to the liquid ejecting section, the liquid ejecting section includes a first region of a first casing that is used as a casing member on an upper surface side of the liquid ejecting apparatus in a state where the liquid ejecting apparatus is being used, a second casing that opposes the first region of the first casing, and a liquid ejecting head that is positioned between the first region of the first casing and the second casing and is configured to eject the liquid, and the containing section includes a second region of the first casing, a fourth casing that opposes the second region of the first casing, and a liquid containing vessel that is positioned between the second region of the first casing and the fourth casing and is configured to contain the liquid.

According to the present invention, since the first casing is shared by the liquid ejecting section and the containing section, there is no separating of the liquid ejecting section and the containing section when being carried by the first casing being grasped. Accordingly, stable carrying is possible.

Next, the present invention is a containing unit configured to supply a liquid through a liquid supply tube to a liquid ejecting apparatus that includes a first casing that has a first penetration hole, a second casing that opposes the first casing and has a second penetration hole that overlaps with the first penetration hole, and a liquid ejecting head that is positioned between the first casing and the second casing and is configured to eject the liquid, the containing unit is provided with a third casing that has an upper surface facing in a vertically upward direction in a state where the liquid ejecting apparatus is being used, a fourth casing opposing the third casing and having a first protruding section, and a liquid containing vessel positioned between the third casing and the fourth casing and configured to contain the liquid, and the containing unit is fixed to the liquid ejecting apparatus in a state where the first protruding section is inserted into the first penetration hole and the second penetration hole.

According to the present invention, the first protruding section of the fourth casing is fixed in a state of penetrating through both the first casing and the second casing. Accordingly, there is little concern that the containing unit will be easily separated from the liquid ejecting apparatus and it is possible to increase the fixing strength compared with in the past.

Next, the present invention is a containing unit configured to supply a liquid through a liquid supply tube to a liquid ejecting apparatus that includes a first casing that has a first penetration hole, a second casing that opposes the first casing and has a second penetration hole that overlaps with the first penetration hole, and a liquid ejecting head that is positioned between the first casing and the second casing and is configured to eject the liquid, the containing unit is provided with a third casing having a second protruding section and an upper surface facing in a vertically upward direction in a state where the liquid ejecting apparatus is being used, a fourth casing opposing the third casing, and a liquid containing vessel positioned between the third casing and the fourth casing and configured to contain the liquid, and the containing unit is fixed to the liquid ejecting apparatus in a state where the second protruding section is inserted into the first penetration hole and the second penetration hole.

According to the present invention, the second protruding section of the third casing is fixed in a state of penetrating through both the first casing and the second casing. Accordingly, there is little concern that the containing unit will be easily separated from the liquid ejecting apparatus and it is possible to increase the fixing strength compared with in the past.

According to the present invention, there is little concern that a containing unit will be easily separated from a liquid ejecting apparatus and it is possible to increase the fixing strength compared with in the past. As such, stable carrying is possible.

BRIEF DESCRIPTION OF THE DRAWINGS

Referring now to the attached drawings which form a part of this original disclosure.

DETAILED DESCRIPTION OF EMBODIMENTS

Embodiments of the liquid ejecting system and a liquid ejecting apparatus where the present invention is applied will be described below with reference to the drawings.

First Embodiment

Figure 1:
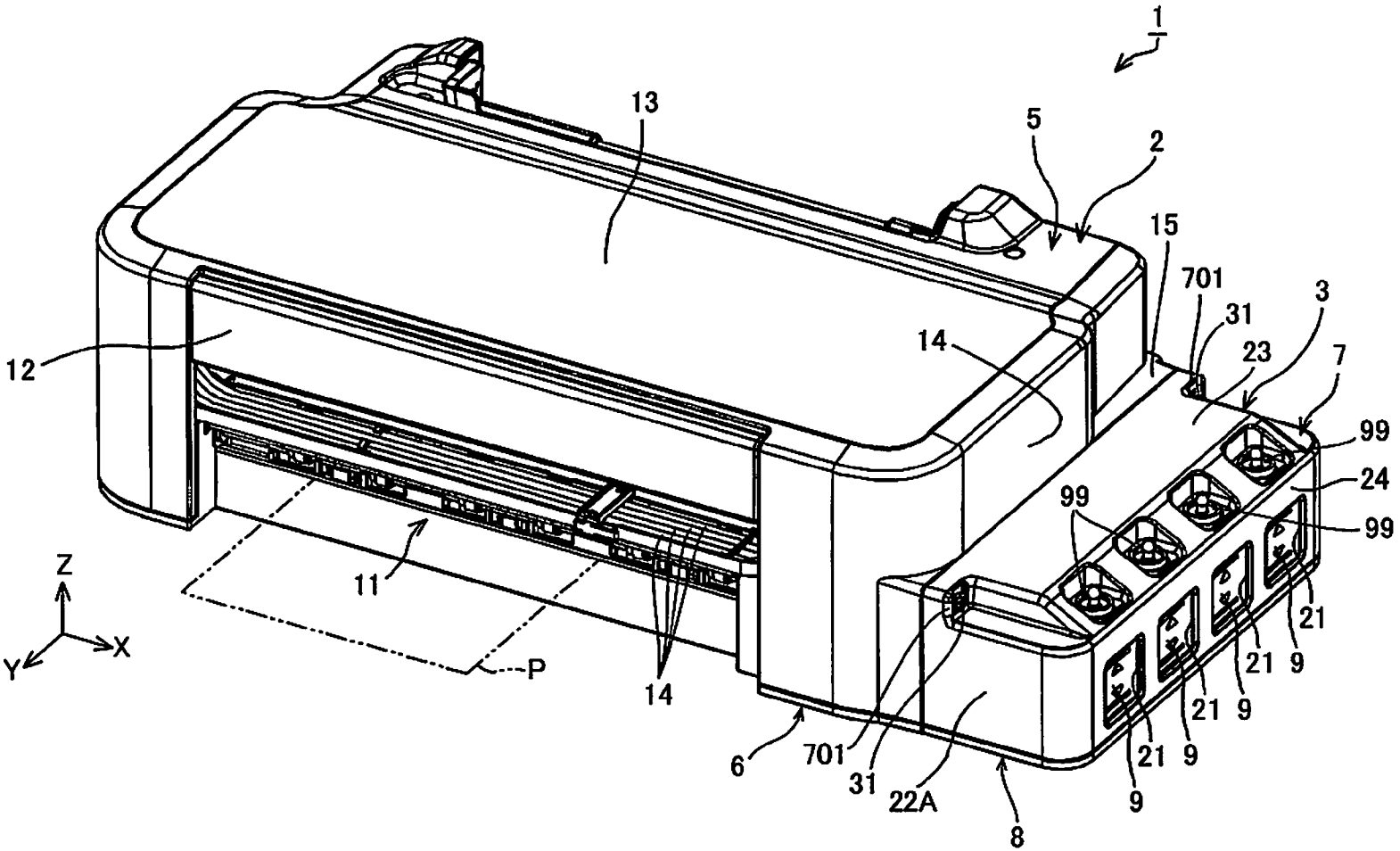
FIG. 1 is a perspective diagram illustrating a liquid ejecting system of a first embodiment.

FIG. 1 is a perspective diagram of a liquid ejecting system of a first embodiment of the present invention. A liquid ejecting system 1 of the first embodiment has an ink jet printer 2 (referred to below as a printer 2), an ink containing unit 3, and a supply tube 4 (a liquid supply tube). The liquid ejecting system 1 performs printing on a printing medium P such as printing paper sheets using ink which is an example of a liquid. The ink is supplied from the ink containing unit 3 to the printer 2 through the supply tube 4. Here, XYZ axes, which are coordinate axes which are orthogonal with each other, are assigned in FIG. 1. The XYZ axes are assigned according to requirements even in diagrams after FIG. 1. Each of the XYZ axes is shown with the direction of the arrow as a + direction (a positive direction) and the reverse direction to the direction of the arrow as a − direction (a negative direction). In a state where the liquid ejecting system 1 is being used, the liquid ejecting system 1 is arranged on a horizontal flat surface (the XY plane) which is regulated by the X axis and the Y axis. In a state where the liquid ejecting system 1 is being used, the Z axis is an axis which is orthogonal to the horizontal flat plane and the −Z axis direction is the vertically downward direction.

Figure 4:
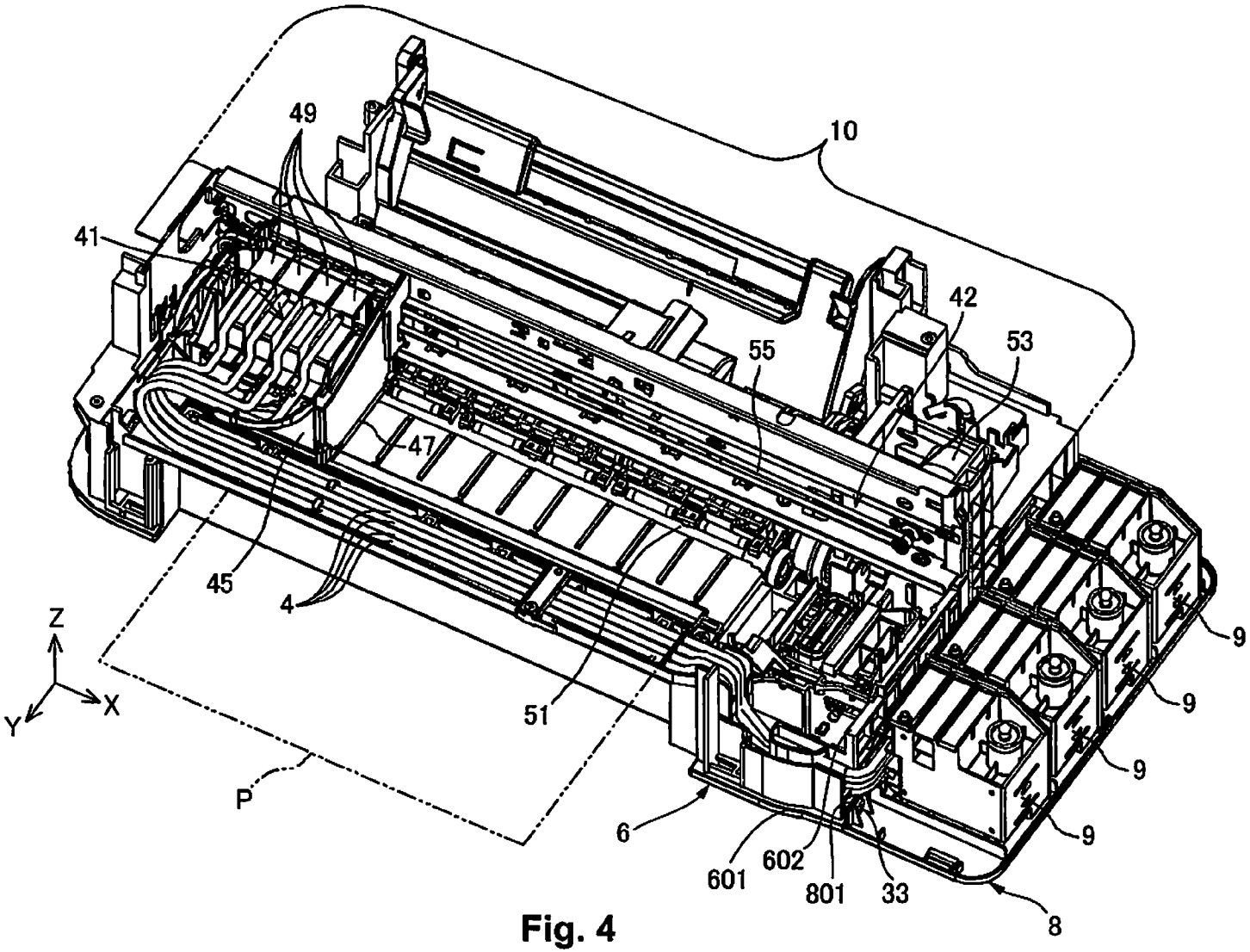
FIG. 4 is a perspective diagram of a liquid ejecting system of the first embodiment in a state where a body cover member and an upper surface cover member are removed.

The printer 2 is an example of a liquid ejecting apparatus and includes a body cover member 5 (a first casing), a body base member 6 (a second casing), and a mechanism unit 10 (refer to FIG. 4). The body cover member 5 opposes the body base member 6 and the mechanism unit 10 is contained between the body cover member 5 and the body base member 6. The mechanism unit 10 is a mechanism portion which executes printing operations. In the printer 2, a surface which faces the +Y axis direction is a front surface 12 and a surface which faces the +Z axis direction (the vertically upward direction) is an upper surface 13. A paper discharge section 11 is provided in the front surface 12. The printing medium P is discharged from the paper discharge section 11.

The ink containing unit 3 is an example of a containing unit which contains a liquid. The ink containing unit 3 is arranged on the +X axis direction side with regard to the printer 2 and is attached to an attachment section 15 which is provided on a side surface 14 so as to be able to be attached to and detached from the printer 2 in the +X axis direction. The ink containing unit 3 includes an upper surface cover member 7 (a third casing), a bottom surface cover member 8 (a fourth casing), and a tank 9 (a liquid containing vessel). The upper surface cover member 7 opposes the bottom surface cover member 8 and the tank 9 is positioned between the upper surface cover member 7 and the bottom surface cover member 8. Four of the tanks 9 are provided and ink which is used in printing is contained in the tanks 9. One each of the tank 9 which contains black ink, the tank 9 which contains yellow ink, the tank 9 which contains magenta ink, and the tank 9 which contains cyan ink are provided in the ink containing unit 3 of the first embodiment. Here, the number of the tanks 9 may be a number other than four and the types of inks which are contained may be different to the four colors of ink described above.

The upper surface cover member 7 is provided with a side wall section 22A which configures the front surface which faces the +Y axial direction, a side wall section 22B (refer to FIG. 7 and FIG. 8) which configures a rear surface side which faces the −Y axial direction, an upper wall section 23 which configures the upper surface which faces in the +Z axial direction, and a side wall section 24 which configures a side surface which faces in the +X axial direction. Four window sections 21 are provided in the side wall section 24 of the upper surface cover member 7. The window sections 21 are openings which penetrate through the side wall section 24. As shown in FIG. 1, the ink containing unit 3 contains four of the tanks 9 described above at positions which overlap with the window sections 21. It is possible for the amount of ink in the tanks 9 to be visually recognized from parts which oppose the window sections 21. An upper limit mark 28 (refer to FIG. 2 and FIG. 3) which indicates an upper limit for the amount of ink and a lower limit mark 29 (refer to FIG. 2 and FIG. 3) which indicates a lower limit for the amount of ink are provided in the tanks 9 at part which oppose the window sections 21.

Figure 2:
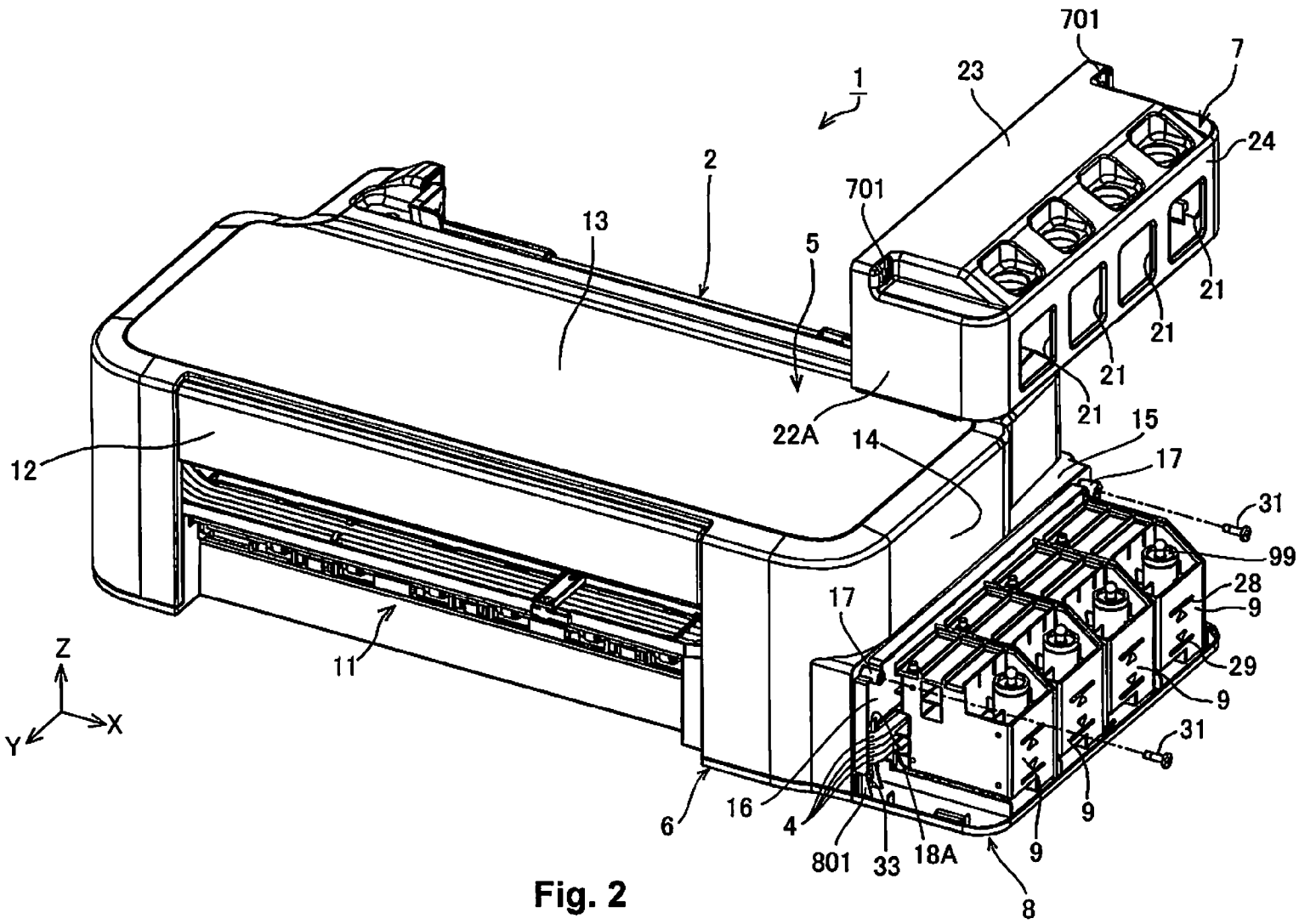
FIG. 2 is an exploded perspective diagram illustrating a liquid ejecting system of the first embodiment (in a state where an upper surface cover member is removed).
Figure 3:
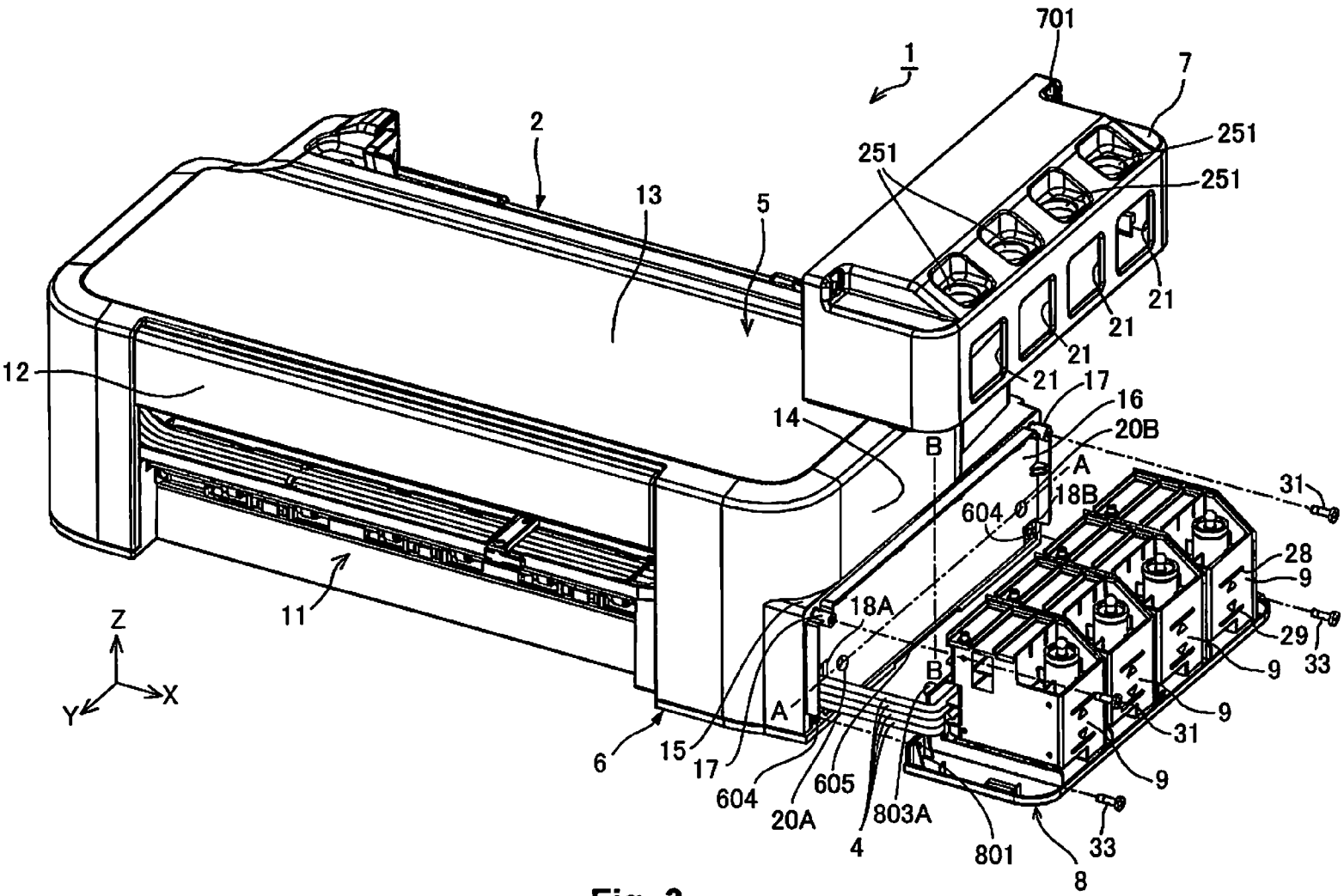
FIG. 3 is an exploded perspective diagram illustrating a liquid ejecting system of the first embodiment (in a state where a tank and a bottom surface cover member are also removed).

FIG. 2 and FIG. 3 are exploded perspective diagrams of the liquid ejecting system 1, FIG. 2 illustrates a state where the upper surface cover member 7 of the ink containing unit 3 is removed, and FIG. 3 illustrates a state where the bottom surface cover member 8 where the tanks 9 are installed is also removed from the printer 2. As shown in FIG. 1, the upper surface cover member 7 is fixed to the body cover member 5 of the printer 2 using attachment pins 31 (a first fixing member). Two fixing sections 701 are provided in the upper surface cover member 7 at end edges which abut with the body cover member 5 (end edges in the −X axis direction). The fixing sections 701 are arranged at two locations of a corner section which is linked with the side wall section 22A on the front surface side from the upper wall section 23 and a corner section which is linked with the side wall section 22B on the rear surface side from the upper wall section 23. A penetration hole is formed in the fixing sections 701 so that the attachment pins 31 are able to be inserted. The upper surface cover member 7 is separated from the body cover member 5 due to the attachment pins 31 being removed as shown in FIG. 2.

The bottom surface cover member 8 is fixed to the body base member 6 using attachment pins 33 (a second fixing member) as shown in FIG. 2. Two fixing sections 801 are provided in the bottom surface cover member 8. The fixing sections 801 are provided at an end section of the bottom surface cover member 8 in the +Y axis direction and an end section of the bottom surface cover member 8 in the −Y axis direction (refer to FIG. 7 and FIG. 8). A penetration hole is formed in the fixing sections 801 so that the attachment pins 33 are able to be inserted. Boss sections 604 (refer to FIG. 3) are formed in the body base member 6 at positions which overlap with the fixing sections 801 in the X axis direction. Once the upper surface cover member 7 is separated from the body cover member 5, the bottom surface cover member 8 is separated from the body base member 6 when the attachment pins 33 are also removed as shown in FIG. 3. Here, fixing of the bottom surface cover member 8 to the body base member 6 and fixing of the upper surface cover member 7 to the base cover member 5 may be performed using a fixing member other than the attachment pins 31 and 33.

As shown in FIG. 3, an attachment surface 16 with a rectangular shape is provided in the attachment section 15 of the body cover member 5. A boss section 17 is provided at each of two location on the +Z axis direction sides out of the four corners of the attachment surface 16. When fixing the upper surface cover member 7, the upper surface cover member 7 is fixed using the attachment pins 31 by each of the bosses 17 being overlaid with the fixing section 701. Cut away sections 18A and 18B are formed in two location on the −Z axis direction sides out of the four corners of the attachment surface 16. The cut away sections 18A and 18B are provided at parts to overlap with the boss sections 604 of the body base member 6. Due to the cut away sections 18A and 18B, the boss sections 604 of the body base member 6 are exposed on the ink containing unit 3 side. When fixing the bottom surface cover member 8, the bottom surface cover member 8 is fixed using the attachment pins 33 by each of the boss sections 604 being overlaid with the fixing section 801.

The cut away section 18A is an opening which is positioned at a side end on the +Y axis direction side of the attachment surface 16 and spreads out to the vicinity of the center of the attachment surface 16 in the Z axis direction. The supply tube 4 is drawn from a region on the +Z axis direction side of the cut away section 18A to the ink containing unit 3 side. Two penetration holes 20A and 20B are further provided in the attachment surface 16. The positions of the penetration hole 20A and the penetration hole 20B are substantially the same in the Z direction, and the penetration hole 20A and the penetration hole 20B are arranged to be separated in the Y axis direction. In the first embodiment, the penetration hole 20A (a first penetration hole) is provided at a part on the +Y axis direction side of the attachment surface 16. In addition, the penetration hole 20B (a third penetration hole) is provided at a part on the −Y axis direction side of the attachment surface 16.

FIG. 4 is a perspective diagram illustrating the liquid ejecting system 1 in a state where the body cover member 5 and the upper surface cover member 7 are removed. The mechanism unit 10 of the printer 2 is supported by the body base member 6. The body base member 6 has a base frame 601 which configures a bottom surface of the apparatus of the printer 2 and a side frame 602 which protrudes in the +Z axis direction from a side end of the base frame 601 in the +X axis direction. The side frame 602 is a part which spreads out along the YZ plane. Ribs which extend in the Z axis direction and ribs which extend in the Y axis direction are arranged with a grid formation on the surface of the side frame 602 in the +X axis direction. The side frame 602 overlaps with a portion or all of the attachment surface 16 of the body cover member 5 when the body base member 6 and the body cover member 5 are pieced together. The boss sections 604 described above are provided in the side frame 602. In addition, a penetration hole 603A (a second penetration hole) is formed in the side frame 602 at a position which overlaps with the penetration hole 20A in the body cover member 5 and a penetration hole 603B (a fourth penetration hole) is formed in the side frame 602 at a position which overlaps with the penetration hole 20B in the body cover member 5. The penetration holes 603A and 603B configure a coupling section which increases the fixing strength of the ink containing unit 3 and the printer 2 along with the penetration holes 20A and 20B in the body cover member 5. The details of the coupling section will be described later.

As shown in FIG. 4, the mechanism unit 10 has a printing section 41, a medium transporting mechanism 42, and a head moving mechanism 43. The printing section 41 has a carriage 45, a printing head 47 (a liquid ejecting head), and four relay units 49. The printing head 47 and the relay units 49 are installed on the carriage 45. The supply tube 4 is connected to each of the relay units 49. The supply tube 4 has flexibility and connects the tank 9 and the relay units 49. The printing head 47 discharges the ink, which is supplied from the tank 9 via the relay units 49 and the supply tube 4, as ink droplets.

The medium transporting mechanism 42 transports the printing medium P along the Y axis direction by a transport roller 51 being driven using motive force from a motor which is not shown in the diagram. The head moving mechanism 43 transports the carriage 45 along the X axis direction by transferring motive force from a motor 53 to the carriage 45 via a timing belt 55. The printing head 47 is transported in the X axis direction via the carriage 45 using the head moving mechanism 43. Due to the medium transporting mechanism 42 and the head moving mechanism 43, printing is carried out on the printing medium P due to ink being discharged from the printing head 47 while the relative position of the printing head 47 is changed with regard to the printing medium P.

Figure 5:
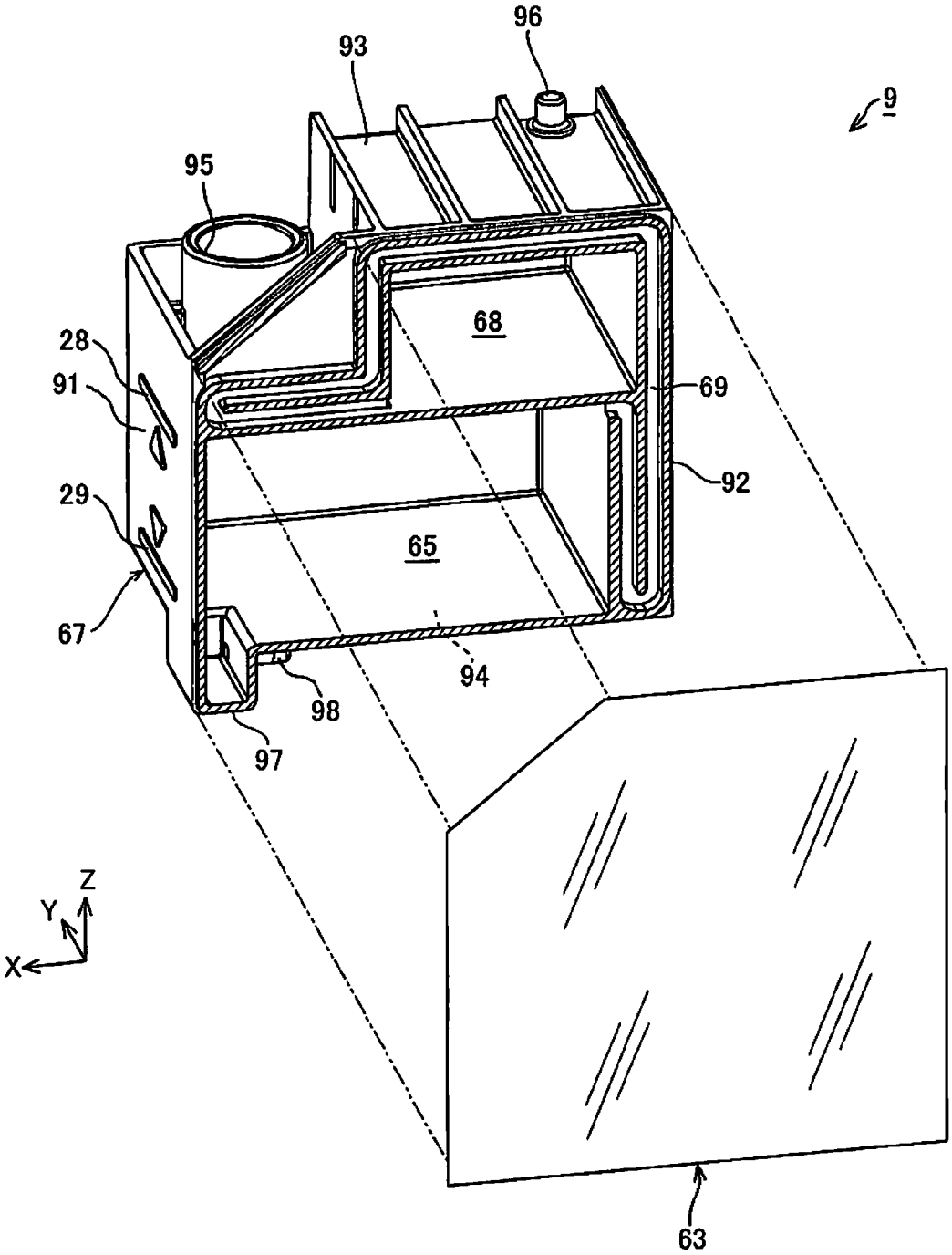
FIG. 5 is an exploded perspective diagram illustrating a tank of the first embodiment.
Figure 6:
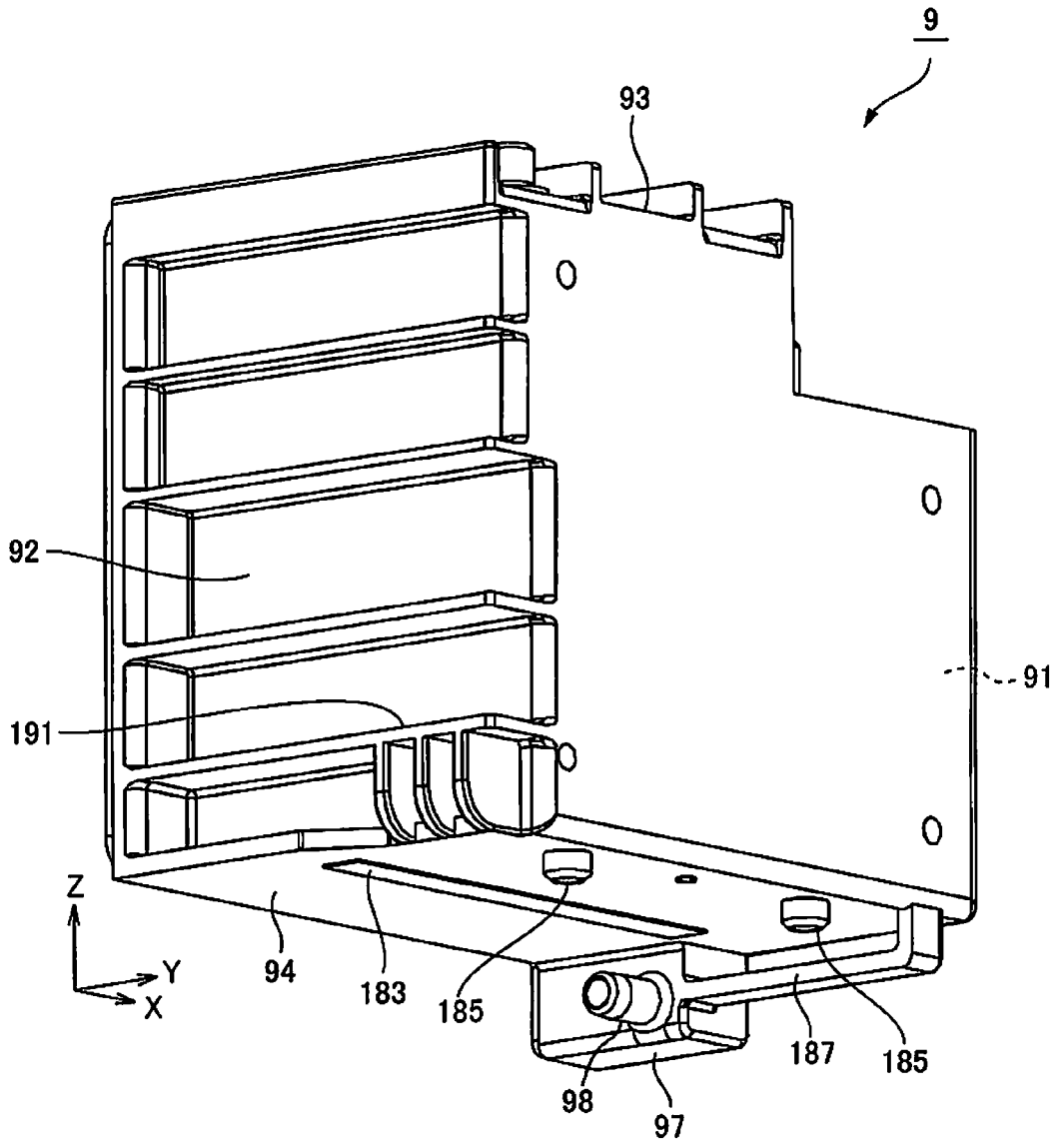
FIG. 6 is a perspective diagram illustrating a tank of the first embodiment.

FIG. 5 is an exploded perspective diagram of the tank 9 and FIG. 6 is a perspective diagram of the tank 9. In the tank 9, a surface which is visually recognized from the window section 21 in the upper surface cover member 7, that is, a surface which faces the +X axis direction, is a front surface 91 of the tank 9. In addition, a surface which faces the −X axis direction is a rear surface 92 of the tank 9. As shown in FIG. 5, the tank 9 has a casing 61 and a sheet member 63. The sheet member 63 is formed in a film shape using a synthetic resin (for example, nylon, polypropylene, and the like) and has flexibility. The sheet member 63 is joined to the casing 61 using a method for joining such as welding.

As shown in FIG. 5, a containing section 65, an atmosphere chamber 68, and a communicating path 69 are provided in an inner section of the tank 9. The containing section 65 and the atmosphere chamber 68 are communicated by the communicating path 69. Ink is contained inside the containing section 65. An ink introduction section 95 is provided in the tank 9 at an upper surface 93 which faces the +Z axis direction. In addition, a portion of the upper surface 93 is projected in the +Z axis direction and an atmosphere communicating opening 96 is provided here. In addition, a supply section 97 is projected from a bottom surface 94 which faces the −Z axis direction in the tank 9. A connection section 98 with a cylindrical shape protrudes from the supply tube 97. The supply tube 4 is connected with the connection section 98. Ink which is contained in the tank 9 is sent out from a supply opening, which is provided at the tip end of the connection section 98, to the supply tube 4. As shown in FIG. 6, a supported section 183, two convex sections 185, and a first engaged section 187 are provided in the bottom surface 94 of the tank 9. In addition, a second engaged section 191 is provided in the rear surface 92 of the tank 9.

Figure 7:
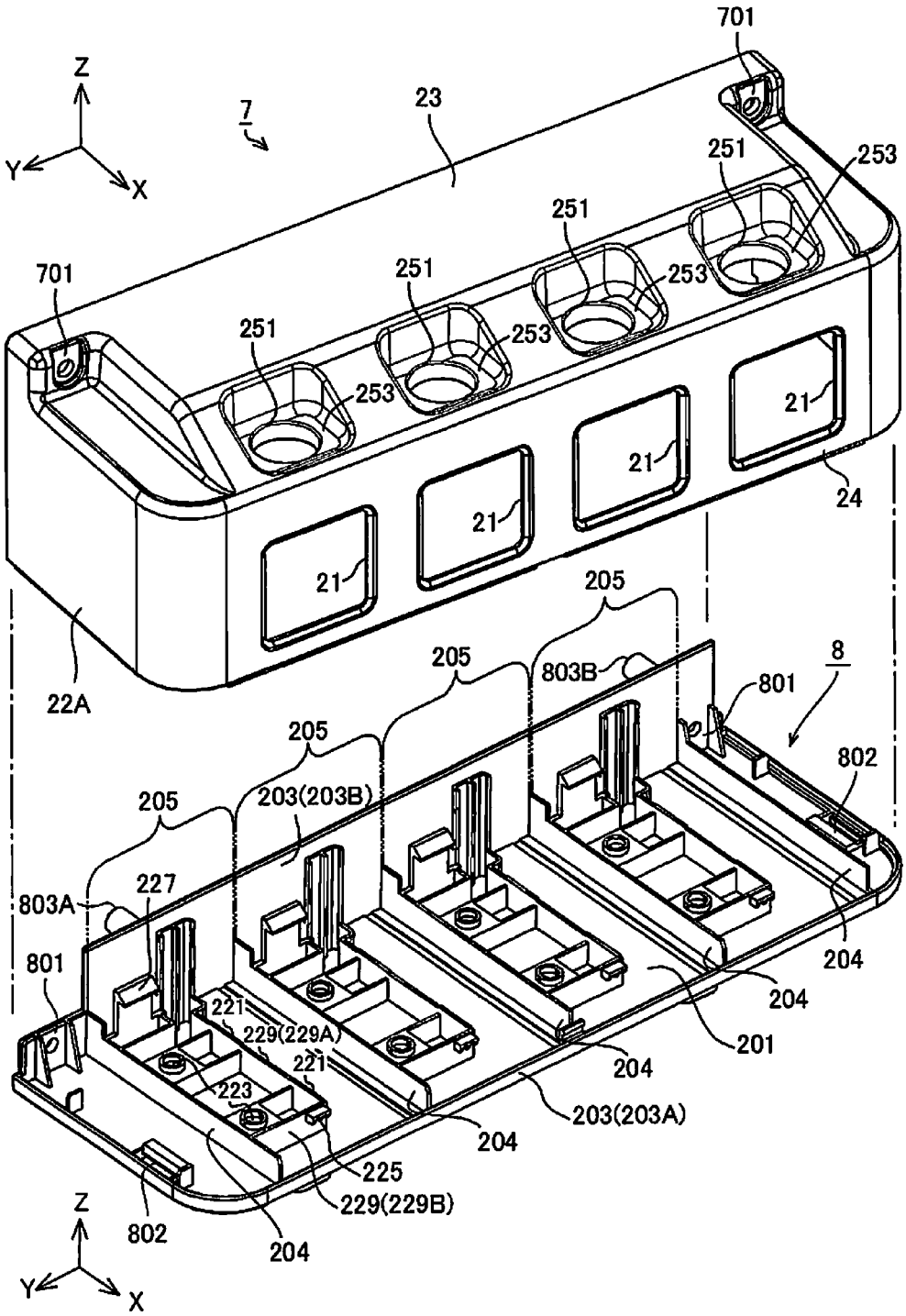
FIG. 7 is an exploded perspective diagram illustrating an upper surface cover member and a bottom surface cover member in an ink containing unit of the first embodiment.
Figure 8:
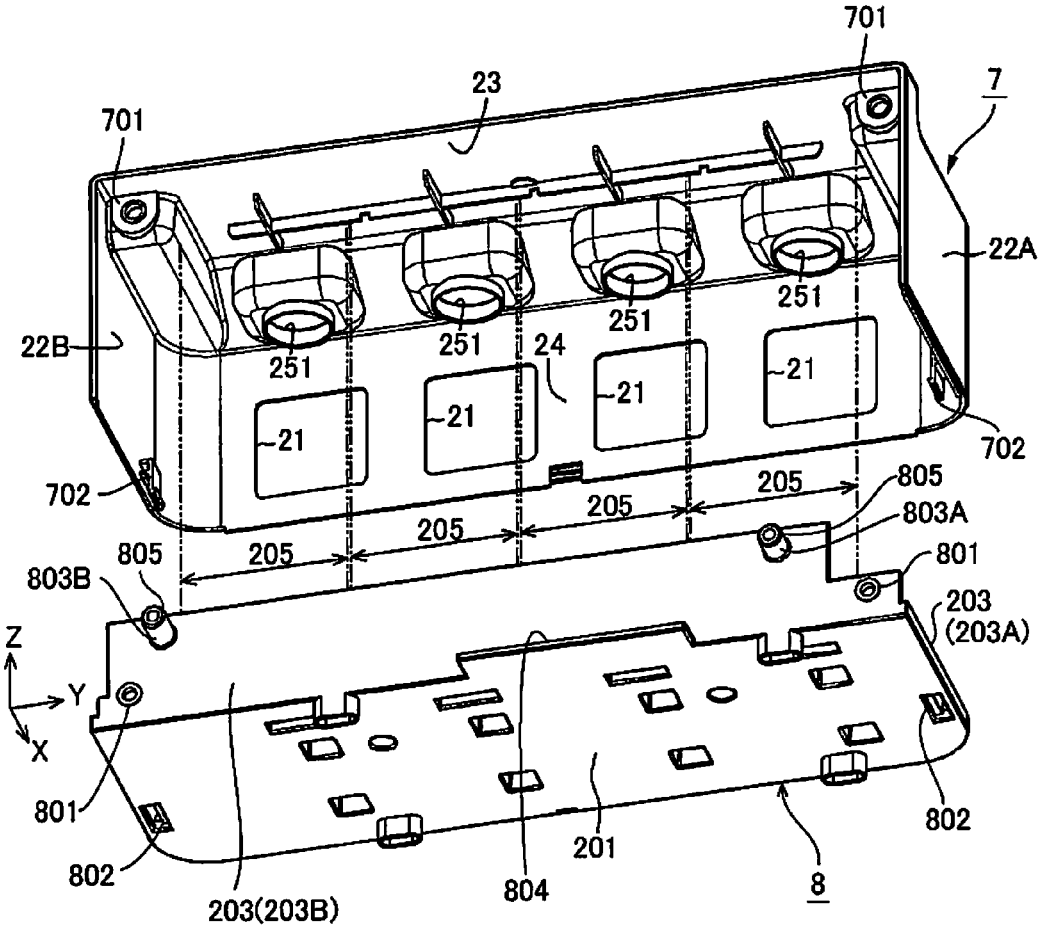
FIG. 8 is an exploded perspective diagram illustrating an upper surface cover member and a bottom surface cover member in an ink containing unit of the first embodiment.

FIG. 7 and FIG. 8 are exploded perspective diagrams illustrating the upper surface cover member 7 and the bottom surface cover member 8 in the ink containing unit 3. As shown in FIG. 7, the bottom surface cover member 8 has a base section 201 with a plate shape which spreads out along the XY plan and a partition wall 203 and a partition wall 204 which protrude from the base section 201 in the +Z axis direction. The partition wall 203 is provided along an outer edge of the base section 201 so as to surround the base section 201. In addition, the partition wall 204 extends in the X axis direction and is linked with the partition wall 203 at both ends in the X axis direction. A plurality of the partition walls 204 are provided. A region between two of the partition walls 204 which are adjacent is a tank arrangement region 205 where one of the tanks 9 is arranged.

Four of the tank arrangement regions 205 are provided. Two mounting sections 221, two concave sections 223, a first engaging section 225, and a second engaging section 227 are provided in each of the tank arrangement regions 205. A mounting wall 229 which protrudes from the base section 201 in the Z axis direction is provided in each of the tank arrangement regions 205. The mounting walls 229 are provided with a mounting wall 229A which extends in the X axis direction and a mounting wall 229B which extends to the Y axis direction side. The two mounting sections 221 protrude from the mounting wall 229A in the +Z axis direction. In addition, the first engaging section 225 protrudes from the mounting wall 229B in the +X axis direction. Then, the second engaging section 227 protrudes from the base section 201 in the +Z axis direction and the tip end thereof has a hook shape.

Figure 9:
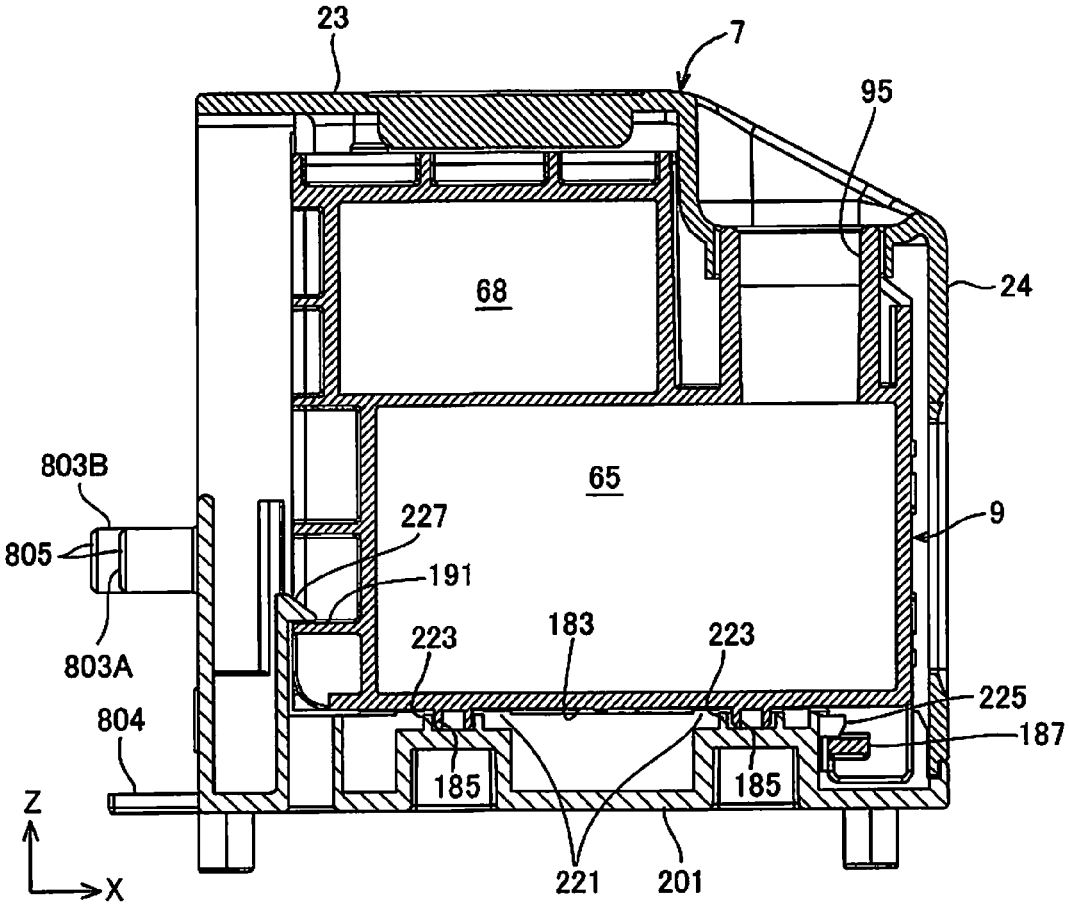
FIG. 9 is a cross sectional diagram where an ink containing unit of the first embodiment is cut away at the XZ plane.

FIG. 9 is a cross sectional diagram where the ink containing unit 3 is cut away at the XZ plane. Four of the tanks 9 are respectively arranged in the tank arrangement regions 205 in the ink containing unit 3. Each of the tanks 9 is fixed to the bottom surface cover member 8 due to engaging of the first engaged section 187 of the tank 9 and the first engaging section 225 of the base section 201 and engaging of the second engaged section 191 of the tank 9 and the second engaging section 227 of the base section 201. In addition, at this time, the two convex sections 185 of the tank 9 are inserted into the two concave sections 223 of the bottom surface cover member 8 and the supported section 183 of the tank 9 abuts with the two mounting sections 221 of the bottom surface cover member 8.

Four openings 251 are provided in the upper surface cover member 7 as shown in FIG. 7. The four openings 251 are respectively formed in concave sections 253 which are formed in the upper wall section 23 of the upper surface cover member 7. The ink introduction section 95 in each of the tanks 9 is exposed to the outer side of the upper surface cover member 7 via respective one of the openings 251. The ink introduction sections 95 are closed off by cap members 99 during printing as shown in FIG. 1. It is possible for the cap members 99 to be removed and ink to be introduced from the ink introduction sections 95 in a state where the tank 9 is contained inside the upper surface cover member 7.

Engaging sections 702 which engaged with the bottom surface cover member 8 are provided at two locations in the upper surface cover member 7 as shown in FIG. 8. One of the engaging sections 702 protrudes from an end edge of the side wall section 22A, which is in the +Y axis direction, in the −Z axis direction. The other of the engaging sections 702 protrudes from an end edge of the side wall section 22B, which is in the −Y axis direction, in the −Z axis direction. The tip ends of the engaging sections 702 face the −Z axis direction and have a hook shape. On the other hand, engaged sections 802 are formed in the base section 201 of the bottom surface cover member 8 at positions which overlap with the engaging sections 702 in the Z axis direction. The engaged sections 802 penetrate through the base section 201. The tip ends of the engaging sections 702 engage with the engaged sections 802 when the upper surface cover member 7 and the bottom surface cover member 8 are pieced together.

A part of the partition wall 203, which protrudes from an end edge which is positioned on the −X axis direction side of the base section 201, has a flat plate shape which spreads out along the YZ plane in the bottom surface cover member 8. Below, this part is a partition wall 203B and other part of the partition walls 203 (a part which encompass the three directions of the +Y axis direction side, the +X axis direction side, and the −Y axis direction side) is a partition wall 203A. The protruding dimensions of the partition wall 203B are larger than the protruding dimensions of the partition wall 203A in the +Z axis direction. Parts on both sides of the partition wall 203B in the Y axis direction configure the fixing sections 801 for screw fixing described above. In addition, two protruding sections 803A and 803B are provided in the partition wall 203B at parts between the two fixing sections 801.

The protruding sections 803A and 803B both have circular cross sections and protrude from the partition wall 203A in the −X axis direction (that is, to the printer 2 side). In addition, the protruding sections 803A and 803B are both provided at positions closer to the tip end of the partition wall 203A on the +Z axis direction and are arranged to be separated in the Y axis direction. The protruding section 803A (a first protruding section) is provided at a position where the penetration hole 20A in the body cover member 5 and the penetration hole 603A in the body base member 6 overlap. In addition, the protruding section 803B (a second protruding section) is provided at a position where the penetration hole 20B in the body cover member 5 and the penetration hole 603B in the body base member 6 overlap. The outer diameter of the protruding section 803A is smaller than the inner diameter of the penetration hole 20A and the penetration hole 603A. In the same manner, the outer diameter of the protruding section 803B is smaller than the inner diameter of the penetration hole 20B and the penetration hole 603B. In the first embodiment, the protruding length of the protruding section 803A which is positioned on the +Y axis direction side is shorter than the protruding length of the protruding section 803B which is positioned on the −Y axis direction side as shown in FIG. 9. Here, the protruding length of the protruding sections 803A and 803B may be the same or the protruding section 803B may be shorter than the protruding length of the protruding section 803A.

A portion of an end edge, which is positioned on the −X axis direction side, of the base section 201 of the bottom surface cover member 8 protrudes in the −X axis direction more than the partition wall 203A as shown in FIG. 8. Below, this part is a protruding section 804 (a third protruding section). The protruding section 804 is positioned closer in the +Y axis direction than the center of the base section 201 in the Y axis direction. As shown in FIG. 3, a concave section 605, where the protruding section 804 is inserted when the bottom surface cover member 8 is attached, is formed in the body base member 6 of the printer 2. A part, where the concave section 605 is formed, in the body base member 6 is a thin section 607 (refer to FIG. 10C).

An assembly process where the ink containing unit 3 is attached to the printer 2 is performed in the following sequence. First, a first process is performed where the bottom surface cover member 8 is positionally aligned with regard to the body base member 6 of the printer 2 from a state where the body cover member 5, the body base member 6, and the mechanism unit 10 of the printer 2 are pieced together. Moreover, after this, a second process is performed where the boss sections 604 and the fixing sections 801 are combined using the two attachment pins 33 as shown in FIG. 2. After this, a third process is performed where the upper surface cover member 7 is positionally aligned with regard to the body cover member 5. In the third process, positional aligning is performed by the upper surface cover member 7 being pieced together to engage with the bottom surface cover member 8. Moreover, after this, a fourth process is performed where the boss sections 17 and the fixing sections 701 are combined using the two attachment pins 31. With the above, there is an assembly completion state as shown in FIG. 1.

Figure 10A:
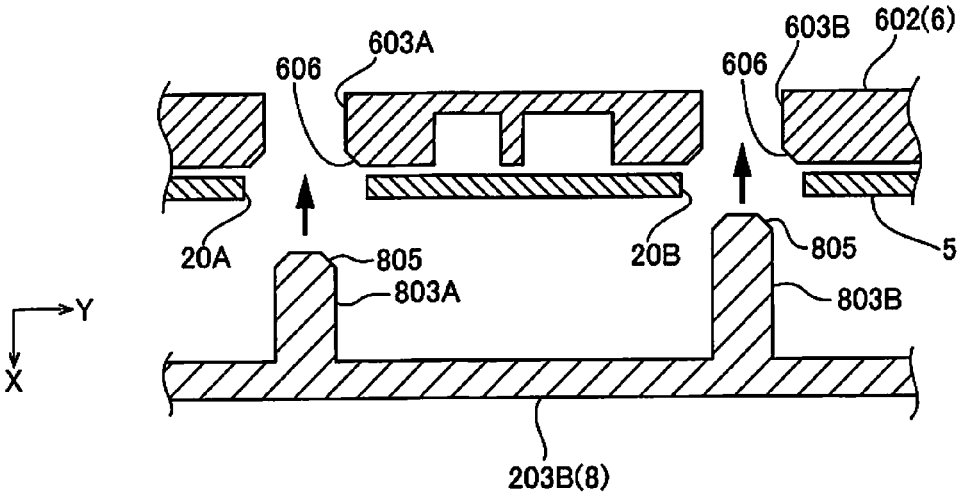
FIGS. 10A to 10C are explanatory diagrams schematically illustrating a coupling section of a printer and an ink containing unit in the first embodiment.
Figure 10B:
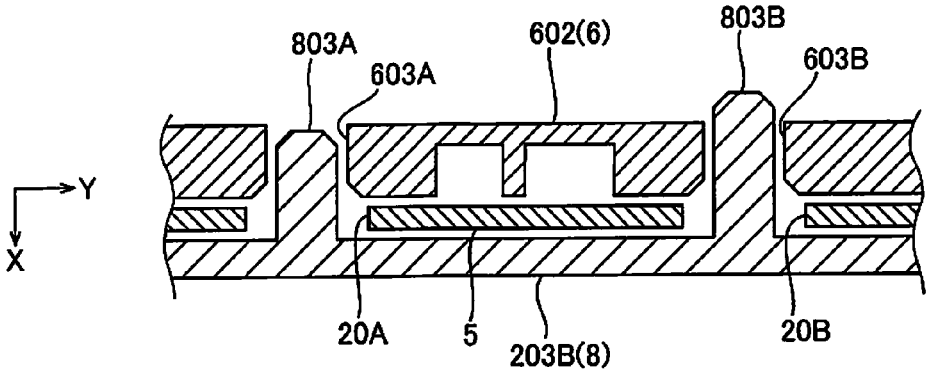
Figure 10C:
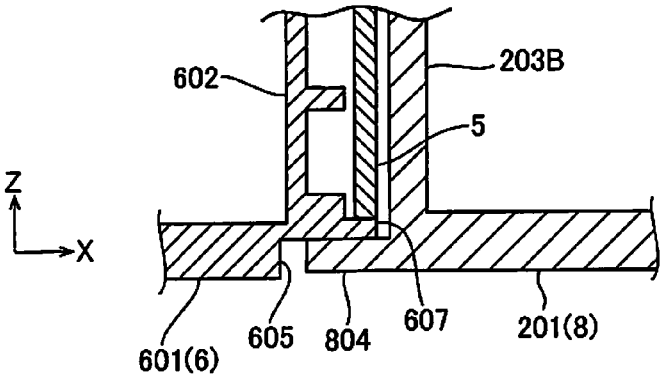

FIGS. 10A to 10C are explanatory diagrams schematically illustrating a structure of a coupling section of the printer 2 and the ink containing unit 3. A coupling section, where the printer 2 and the ink containing unit 3 are coupled together, other than the screw fixing section using the attachment pins 31 and 33 is provided in the liquid ejecting system 1. In the first embodiment, the bottom surface cover member 8, the body cover member 5, and the body base member 6 are pieced together so that the penetration 20A, the penetration 603A, and the protruding section 803A are arranged on the same axis and the penetration 20B, the penetration 603B, and the protruding section 803B are arranged on the same axis. FIGS. 10A and 10B are cross sectional configurations of the coupling section which are cut away at the XY plane which includes a line A-A in FIG. 3, FIG. 10A illustrates a state where the bottom surface cover member 8 is removed, and FIG. 10B illustrates a state where the bottom surface cover member 8 is fixed to the body base member 6. When the first process described above is performed, the protruding section 803A is inserted into the penetration hole 20A and the penetration hole 603A, and the protruding section 803B is inserted into the penetration hole 20B and the penetration hole 603B.

Taper sections 805 are provided at the tip end surfaces of the protruding sections 803A and 803B along the outer circumference edges. In addition, the inner diameters of the penetration holes 20A and 20B are one size larger than the inner diameters of the penetration holes 603A and 603B, and a part which surrounds the penetration holes 603A and 603B is exposed from the penetration holes 20A and 20B to have an annular shape in a case of being viewed from the −X axis direction. Taper sections 606 are provided in the exposed parts along the edge of the penetration holes 603A and 603B. In this manner, it is possible for a process for inserting of the protruding sections 803A and 803B to be easily performed due to the taper sections 805 and the taper sections 606 being provided. Here, the taper sections 606 may be omitted with the penetration holes 20A and 20B and the penetration holes 603A and 603B having the same inner diameters. In addition, taper sections may be provided along the edges of the penetration holes 20A and 20B.

FIG. 10C is a cross sectional configuration which is cut away at the XZ plane which includes a line B-B in FIG. 3 and illustrates a state where the bottom surface cover member 8 is fixed to the body base member 6. As shown in the diagram, the protruding section 804 of the bottom surface cover member 8 is inserted into the convex section 605 of the body base member 6 when the first process described above is performed. When the protruding section 804 is inserted into the convex section 605, the thin section 607 of the body base member 6 is interposed between the protruding section 804 and the body cover member 5. Accordingly, the body cover member 5 and the bottom surface cover member 8 are fixed in a state where the body base member 6 is interposed.

As above, the liquid ejecting system 1 of the first embodiment is provided with the printer 2, the ink containing unit 3 where it is possible for ink to be contained, and the supply tube 4, the printer 2 includes the body cover member 5, the body base member 6 which opposes the body cover member 5, and the printing head 47 which is positioned between the body cover member 5 and the body base member 6, the ink containing unit 3 includes the upper surface cover member 7, the bottom surface cover member 8 which opposes the upper surface cover member 7, and the tank 9 which is positioned between the upper surface cover member 7 and the bottom surface cover member 8, the body cover member 5 has the penetration holes 20A and 20B, the body base member 6 has the penetration holes 603A and 603B which overlap with the penetration holes 20A and 20B, the bottom surface cover member 8 has the protruding sections 803A and 803B, and the ink containing unit 3 is fixed to the printer 2 in a state where the protruding sections 803A and 803B are inserted into the penetration holes 20A and 20B and the penetration holes 603A and 603B.

In this manner, the protruding sections 803A and 803B of the bottom surface cover member 8 are coupled to the printer 2 so as to penetrate both the body cover member 5 and the body base member 6 in the first embodiment. By providing coupling sections in this manner, it is possible to increase the fixing strength in a direction (the YZ direction) which intersects with the insertion direction of the protruding sections 803A and 803B. In addition, these coupling sections are provided at positions which are separated in the +Z axis direction with regard to the screw fixing positions. For this reason, there is hardly any concerns that the bottom surface cover member 8 will be tiled due to the weight of the tank 9 or the like and the ink containing unit 3 will separate from the printer 2 when the entire liquid ejecting system 1 is lifted up. Accordingly, it is possible to increase the fixing strength of the printer 2 and the ink containing unit 3 in the liquid ejecting system 1 and stable carrying is possible.

In addition, the protruding section 804 of the bottom surface cover member 8 is inserted into the concave section 605 of the body base member 6 in the first embodiment. For this reason, the ink containing unit 3 is fixed with regard to the printer 2 in a state where the body cover member 5 and the bottom surface cover member 8 interpose the body base member 6. Due to this, it is possible to further increase the fixing strength of the printer 2 and the ink containing unit 3. Accordingly, it is possible to more stably carry the liquid ejecting system 1.

Here, the coupling sections of the bottom surface cover member 8 and the members on the printer 2 side are provided at two locations in the first embodiment, but the coupling sections may be only provided at one location. In addition, the coupling sections may be provided at three or more locations. In addition, the protruding section 804 may be arranged on the lower side of the bottom surface of the body base member 6. In this case, it is not necessary for the concave section 605 to be provided in the body base member 6.

Modified Example 1

Figure 11A:
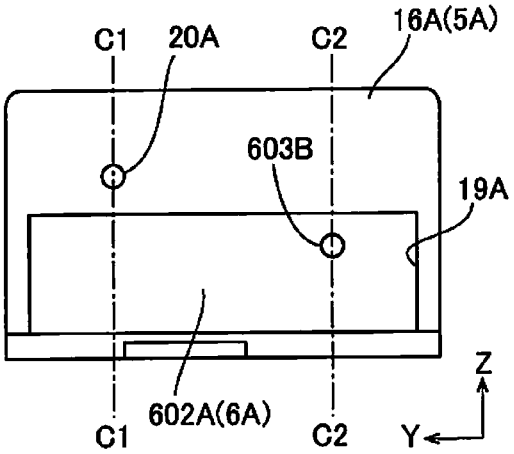
FIGS. 11A to 11D are explanatory diagrams schematically illustrating modified example 1 of a coupling section of a printer and an ink containing unit.
Figure 11B:
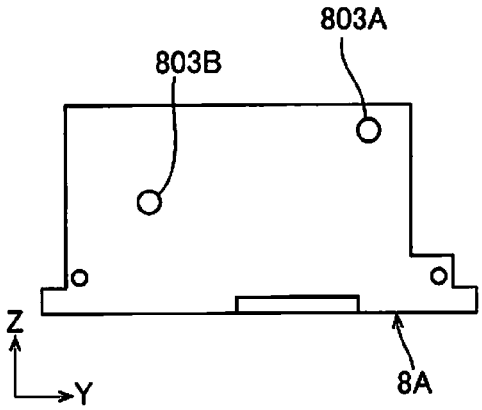
Figure 11C:
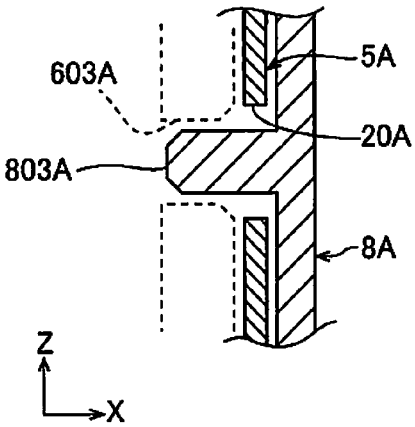
Figure 11D:
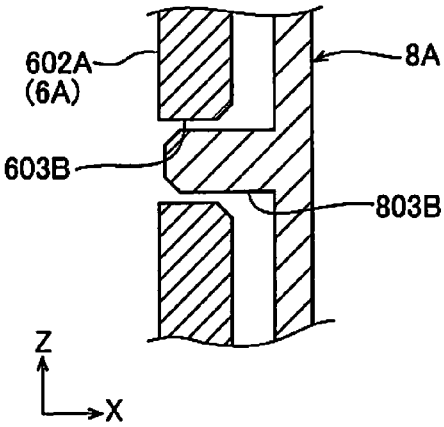

FIGS. 11A to 11D are explanatory diagrams schematically illustrating modified example 1 of a coupling section of the printer 2 and the ink containing unit 3. Only configurations in the modified example which are different from the aspects shown in FIG. 1 to FIG. 10 will be described below. In addition, configurations which are the same as the first embodiment are given the same reference numerals. FIG. 11A is a side surface diagram (a diagram viewed from the −X axis direction) schematically illustrating a body cover member 5A and a body base member 6A of modified example 1 and FIG. 11B is a side surface diagram (a diagram viewed from the +X axis direction) schematically illustrating a bottom surface cover member 8A of modified example 1. In addition, FIGS. 11C and 11D are respective cross sectional configurations of a coupling section which is cut away at the XZ plane at positions of a line C1-C1 and a line C2-C2 in FIG. 11A.

In modified example 1, a cut away section 19A with a rectangular shape, where a substantial part on the −Z axis direction side is cut away, is provided in an attachment surface 16A of the body cover member 5A (the first casing) as shown in FIG. 11A. A side frame 602A of the body base member 6A (the second casing) is exposed from the cut away section 19A to the ink containing unit 3 side. The penetration hole 20A (the first penetration hole) is provided in the attachment surface 16A at a position closer to the +Y axis direction. The penetration hole 603B (the second penetration hole) is provided in the side frame 602 at a part which is exposed inside the cut away section 19A. The penetration hole 20A and the penetration hole 603B are arranged to be separated in the Y axis direction. On the other hand, the protruding section 803A (the first protruding section) is provided in the bottom surface cover member 8A (the fourth casing) at a position which overlaps with the penetration hole 20A in the X axis direction in modified example 1 as shown in FIG. 11B. In addition, the protruding section 803B (the second protruding section) is provided at a position which overlaps with the penetration hole 603B in the X axis direction.

The protruding section 803A is inserted into the penetration hole 20A as shown in FIG. 11C when the bottom surface cover member 8A is fixed to the body base member 6A. In addition, the protruding section 803B is inserted into the penetration hole 603B as shown in FIG. 11D. Accordingly, the ink containing unit 3 is fixed to the printer 2 in a state where the protruding section 803A is inserted into the penetration hole 20A and the protruding section 803B is inserted into the penetration hole 603B. Here, a penetration hole 603A is provided at a position which overlaps with the penetration hole 20A in a case where the side frame 602A overlaps with the penetration hole 20A as shown by the dashed line in FIG. 11C.

In this manner, the protruding sections 803A and 803B of the bottom surface cover member 8A are coupled to the printer 2 so as to each penetrate through the body cover member 5A and the body base member 6A in modified example 1. Due to this, it is possible to increase the fixing strength in a direction (the YZ direction) which intersects with the insertion direction of the protruding sections 803A and 803B. Accordingly, it is possible to increase the fixing strength of the printer 2 and the ink containing unit 3 and stable carrying is possible.

Modified Example 2

Figure 12A:
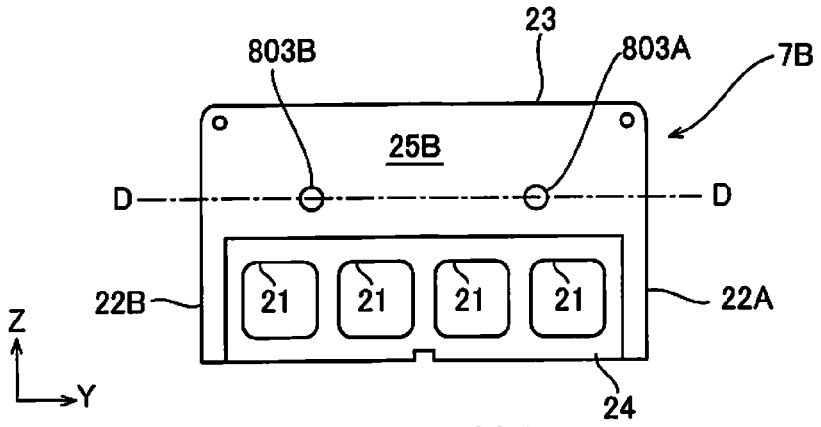
FIGS. 12A to 12C are explanatory diagrams schematically illustrating modified example 2 of a coupling section of a printer and an ink containing unit.
Figure 12B:
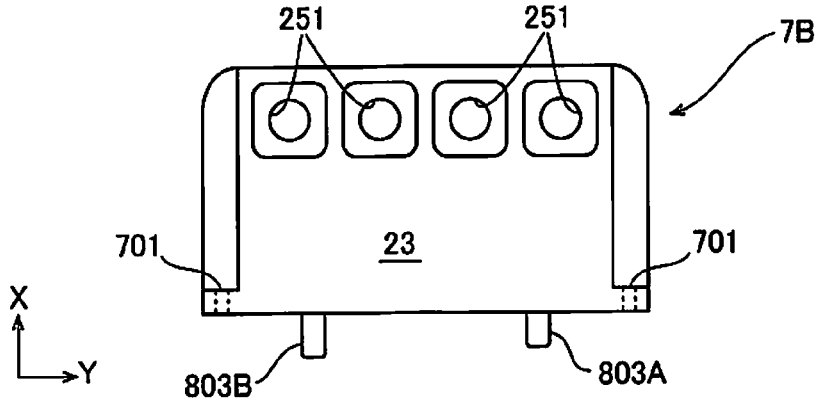
Figure 12C:
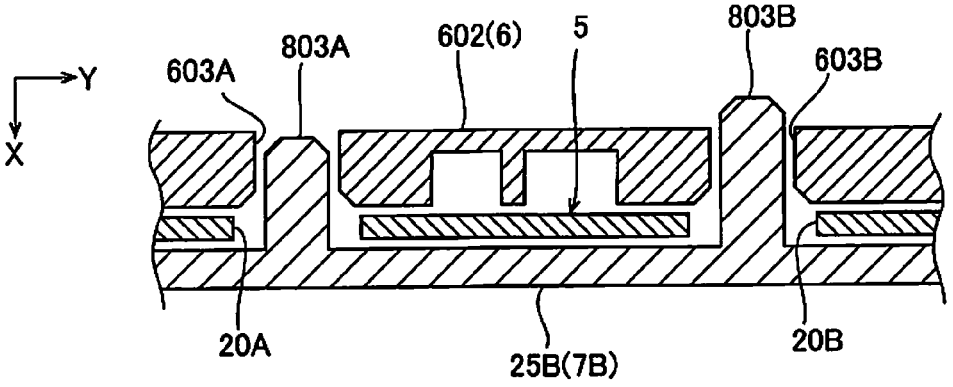

FIGS. 12A to 12C are explanatory diagrams schematically illustrating modified example 2 of a coupling section of the printer 2 and the ink containing unit 3. FIGS. 12A and 12B schematically illustrate an upper surface cover member 7B of modified example 2, FIG. 12A is a side surface diagram viewed from the +X axis direction, and FIG. 12B is an upper surface diagram viewed from the −Z axis direction. In addition, FIG. 12C is a cross sectional configuration of a coupling section which is cut away at the XZ plane which includes a line D-D in FIG. 12A. In modified example 2, the upper surface cover member 7B (the third casing) and a bottom surface cover member 8B (the fourth casing) are fixed with regard to the printer 2 which is the same as in the first embodiment. That is, the penetration holes 20A and 20B (the first penetration hole and the third penetration hole) and the penetration holes 603A and 603B (the second penetration hole and the fourth penetration hole) are provided at the same positions on the printer 2 side as in the first embodiment.

As shown in FIG. 12A, a side wall section 25B extends toward the −Z axis direction, from an end edge of the upper wall section in the −X axis direction, in the upper surface cover member 7B of modified example 2. Both ends of the side wall section 25B in the Y axis direction are linked with the side wall sections 22A and 22B. The side wall section 25B extends to a position which overlaps with the penetration holes 20A and 20B which are provided on the printer 2 side. As shown in FIG. 12B, the protruding sections 803A and 803B (the first protruding section and the second protruding section), which protrude from the side wall section 25B in the −X axis direction, are provided in the upper surface cover member 7B. The protruding sections 803A and 803B are provided at positions which overlap with the penetration holes 20A and 20B in the X axis direction. On the other hand, the bottom surface cover member 8B (refer to FIG. 13A) is provided with a partition wall 203C instead of the partition wall 203B. The partition wall 203C has a shape where the protruding sections 803A and 803B are omitted from the partition wall 203B of the first embodiment and the partition wall 203B does not interfere with the side wall section 25B of the upper surface cover member 7B. In modified example 2, the protruding sections 803A and 803B are not provided in the bottom surface cover member 8B and are provided in the upper surface cover member 7B.

The protruding section 803A is inserted into the penetration hole 20A and the penetration hole 603A as shown in FIG. 12C when the upper surface cover member 7B is fixed to the body cover member 5 (the first casing). In the same manner, the protruding section 803B is inserted into the penetration hole 20B and the penetration hole 603B. Accordingly, the ink containing unit 3 is fixed to the printer 2 in a state where the protruding sections 803A and 803B are inserted into the penetration holes 20A and 20B and the penetration holes 603A and 603B.

In this manner, the protruding sections 803A and 803B of the upper surface cover member 7B are coupled to the printer 2 so as to each penetrate through the body cover member 5 and the body base member 6 (the second casing) in modified example 2. Due to this, it is possible to increase the fixing strength in a direction (the YZ direction) which intersects with the insertion direction of the protruding sections 803A and 803B. Accordingly, it is possible to increase the fixing strength of the printer 2 and the ink containing unit 3 and stable carrying is possible. Here, the coupling sections of the upper surface cover member 7B and the members on the printer 2 side are provided at two locations, but the coupling sections may be only provided at one location. In addition, the coupling sections may be provided at three or more locations.

Modified Example 3

Figure 13A:
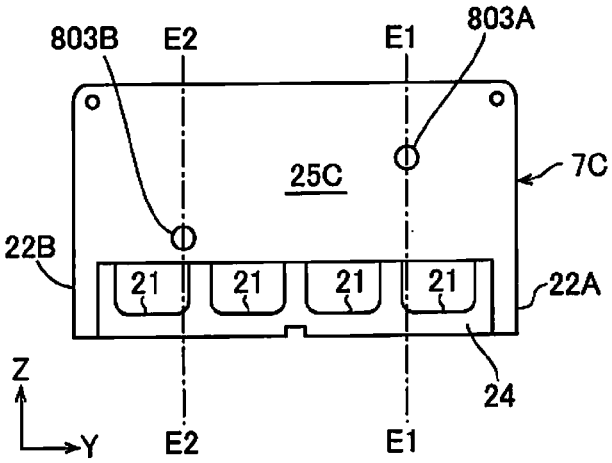
FIGS. 13A to 13D are explanatory diagrams schematically illustrating modified example 3 of a coupling section of a printer and an ink containing unit.
Figure 13B:
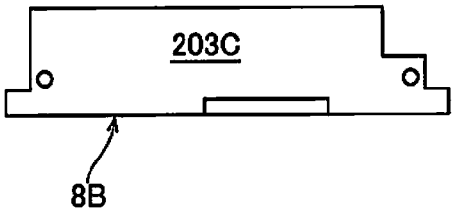
Figure 13C:
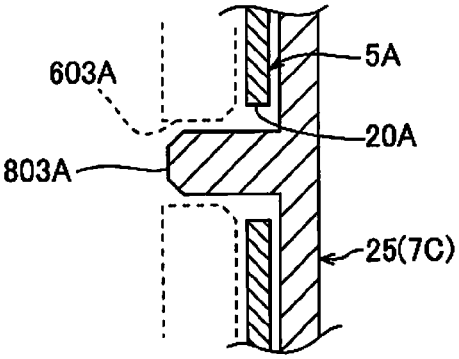
Figure 13D:
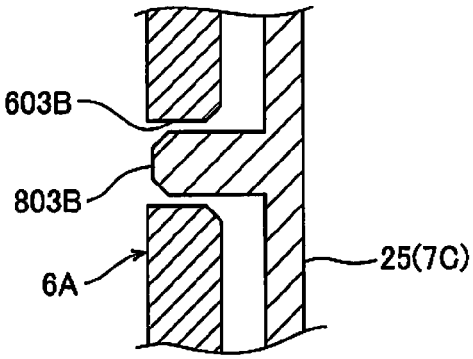

FIGS. 13A to 13D are explanatory diagrams schematically illustrating modified example 3 of a coupling section of the printer 2 and the ink containing unit 3. The configuration (refer to FIG. 11A) with the body cover member 5A (the first casing) and the body base member 6A (the second casing) in modified example 1 is adopted as the configuration on the printer side in modified example 3. In addition, the configuration with the bottom surface cover member 8B where the protruding sections 803A and 803B are not provided in the same manner as modified example 2 is adopted as the configuration on the ink containing unit side. FIG. 13A is a side surface diagram (a diagram viewed from the +X axis direction) schematically illustrating an upper surface cover member 7C of modified example 3. In addition, FIG. 13B is a side surface diagram (a diagram viewed from the +X axis direction) schematically illustrating the bottom surface cover member 8B of modified examples 2 and 3. Then, FIGS. 13C and 13D are respective cross sectional configurations of a coupling section when cut away at the XY plane which includes a line E1-E1 and a line E2-E2 in FIG. 13A.

As shown in FIG. 13A, the upper surface cover member 7C (the third casing) of modified example 3 is provided with a side wall section 25C in a region where the penetration hole 20A of the body cover member 5A and the penetration hole 20B of the body base member 6A overlap. The protruding section 803A (the first protruding section) is provided in the side wall section 25C at a position which overlaps with the penetration hole 20A in the X axis direction. In addition, the protruding section 803B (the second protruding section) is provided in the side wall section 25C at a position which overlaps with the penetration hole 603B in the X axis direction. On the other hand, the bottom surface cover member 8B is provided with a partition wall 203C with a shape which does not interfere with the side wall section 25C instead of the partition wall 203B of the first embodiment as shown in FIG. 13B. The protruding sections 803A and 803B is not provided in the partition wall 203C.

As shown in FIGS. 13C and 13D, the protruding section 803A is inserted into the penetration hole 20A (the first penetration hole) and the protruding section 803B is inserted into the penetration hole 603B (the second penetration hole) when the upper surface cover member 7C is fixed in the body cover member 5A. Accordingly, the ink containing unit 3 is fixed to the printer 2 in a state where the protruding section 803A is inserted into the penetration hole 20A and the protruding section 803B is inserted into the penetration hole 603B. Here, it is possible for the penetration hole 603A to be provided at a position which overlaps with the penetration hole 20A in a case where the side frame 602A overlaps with the penetration hole 20A as shown by the dashed line in FIG. 13C.

In this manner, the protruding sections 803A and 803B of the upper surface cover member 7C are coupled to the printer 2 so as to each penetrate through the body cover member 5A and the body base member 6A in modified example 3. Due to this, it is possible to increase the fixing strength in a direction (the YZ direction) which intersects with the insertion direction of the protruding sections 803A and 803B. Accordingly, it is possible to increase the fixing strength of the printer 2 and the ink containing unit 3 and stable carrying is possible.

Other Modified Examples

Configurations where the first embodiment and modified examples 1 to 3 may be adopted as the present invention. That is, it is possible for coupling sections to be provided by appropriately combining a coupling section where a protruding section which is provided in the upper surface cover member 7 is inserted into a penetration hole which is provided in one or both of the body cover member 5 and the body base member 6 and a coupling section where a protruding section which is provided in the bottom surface cover member 8 is inserted into a penetration hole which is provided in one or both of the body cover member 5 and the body base member 6. In addition, the number and positions of the coupling sections are not limited to the first embodiment and modified examples 1 to 3 and appropriate modifications are possible. Furthermore, either or both of screw fixing using the attachment pins 31 and screw fixing using the attachment pins 33 may be omitted in these configurations.

In addition, it is possible to adopt a concave section instead of penetration holes in the first embodiment and modified examples 1 to 3. That is, the penetration holes 603A and 603B are parts in which the tip ends of the protruding sections 803A and 803B are inserted in the first embodiment and modified example 2. Accordingly, it is not necessary to penetrate through the side frame 602 in a case where the dimensions of the protruding sections 803A and 803B are short and there may be concave sections. In addition, the penetration hole 603B in modified example 1 and 3 may be a concave section in the same manner. Furthermore, it is possible for the penetration hole 20A to be a concave section in a case where the protruding dimensions of the protruding section 803A are shortened in modified examples 1 and 3.

Second Embodiment

Figure 14:
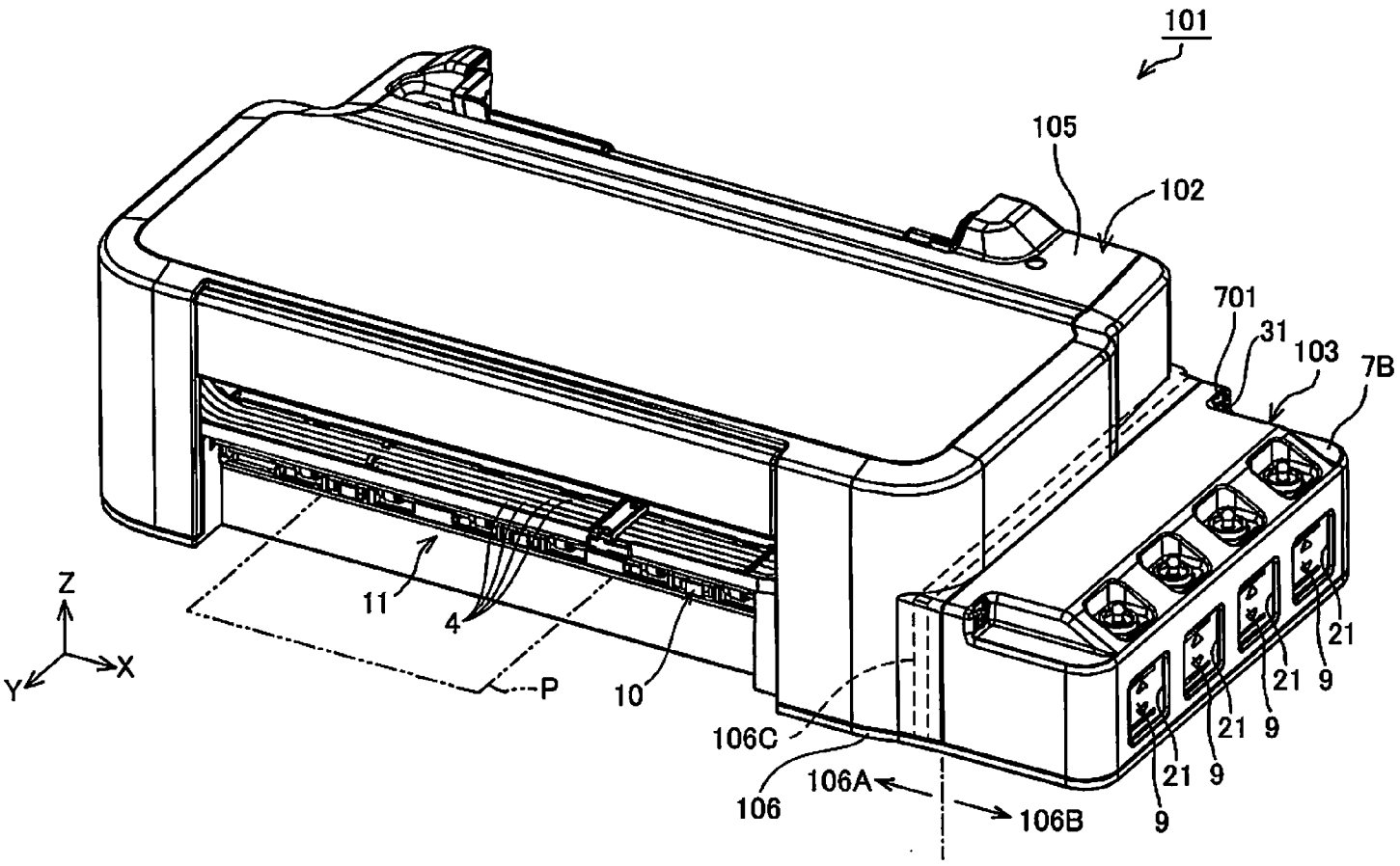
FIG. 14 is a perspective diagram illustrating a liquid ejecting system of a second embodiment.

FIG. 14 is a perspective diagram of a liquid ejecting system according to a second embodiment of the present invention. Portions which are the same as the first embodiment are given the same reference numerals, the description thereof is omit, and only portions which are different will be described. As shown in the diagram, a liquid ejecting apparatus 101 of the second embodiment has a liquid ejecting section 102, an ink containing section 103 (the containing section), and the supply tube 4 (the liquid supply tube). An ink jet printer where printing is performed on the printing medium P such as paper sheets using ink which is an example of liquid is shown as an example of the liquid ejecting apparatus 101 in the second embodiment. The ink which is used is supplied from the ink containing section 103 to the liquid ejecting section 102 via the supply tube 4.

The liquid ejecting section 102 includes a body cover member 105 (the first casing), a first region 106A of a base member 106 (the second casing) which opposes the body cover member 105, and a mechanism unit 10 (refer to FIG. 4). The first region 106A is a part on the −X axis direction side of the base member 106. The mechanism unit 10 is positioned between the body cover member 105 and the first region 106A of the base member 106. The mechanism unit 10 is a mechanism portion which executes printing operations. A paper discharge section 11 is provided in the liquid ejecting section 102 in a front surface which faces the +Y axis direction.

The ink containing section 103 includes the upper surface cover member 7B (the third casing), a second region 106B of the base member 106 which opposes the upper surface cover member 7B, and a plurality (two or more) of the tanks 9. The second region 106B is a part on the +X axis direction side of the base member 106. The plurality of tanks 9 are positioned between the upper surface cover member 107 and the first region 106A of the base member 106. Four of the tanks 9 are provided in the second embodiment in the same manner as the first embodiment. The upper surface cover member 7B has the same configuration as in modified example 2 as will be described later.

The liquid ejecting apparatus 101 is provided with the base member 106 which configures the bottom surface of the apparatus. The base member 106 is provided with the first region 106A which supports the mechanism unit 10, the second region 106B which supports the four tanks 9, and a side frame 106C which is provided at the interface between the first region 106A and the second region 106B. The first region 106A and the second region 106B as a whole configure a base frame for the liquid ejecting apparatus 101. The side frame 106C spreads out along the YX plane so as to cut across an arrangement region for the mechanism unit 10 and an arrangement region for the tank 9. The mechanism unit 10 is configured in the same manner as the first embodiment and has the printing section 41, the medium transporting mechanism 42, and the head moving mechanism 43. The printing section 41 has the carriage 45, the printing head 47 (the liquid ejecting head), and four of the relay units 49. The medium transporting mechanism 42 is provided with the transport motor 51 and a motor which drives the transport motor 51. In addition, the head moving mechanism 43 is provided with the motor 53, the timing belt 55, and the like (refer to FIG. 4).

Figure 15:
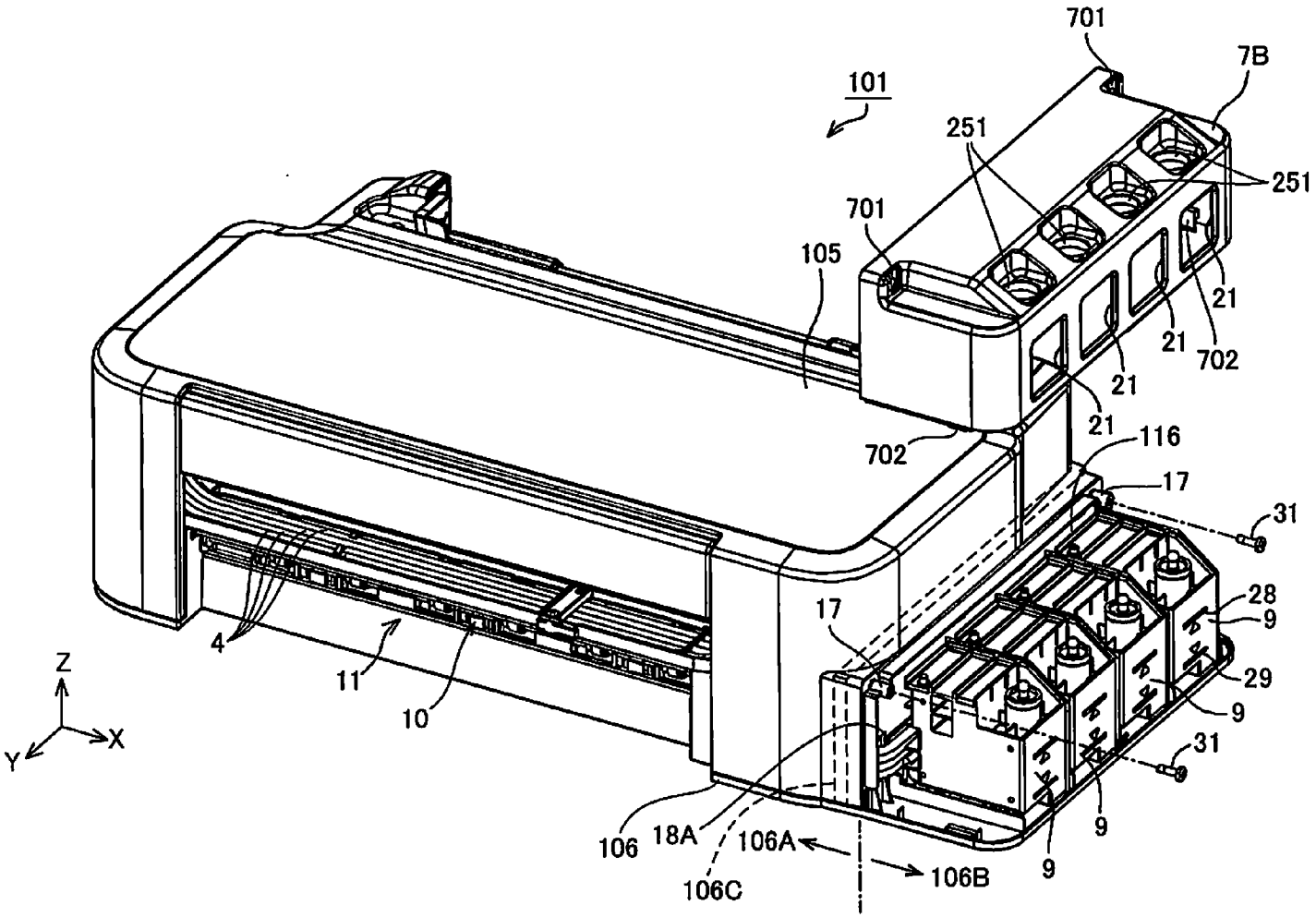
FIG. 15 is an exploded perspective diagram illustrating a liquid ejecting system of the second embodiment.
Figure 16:
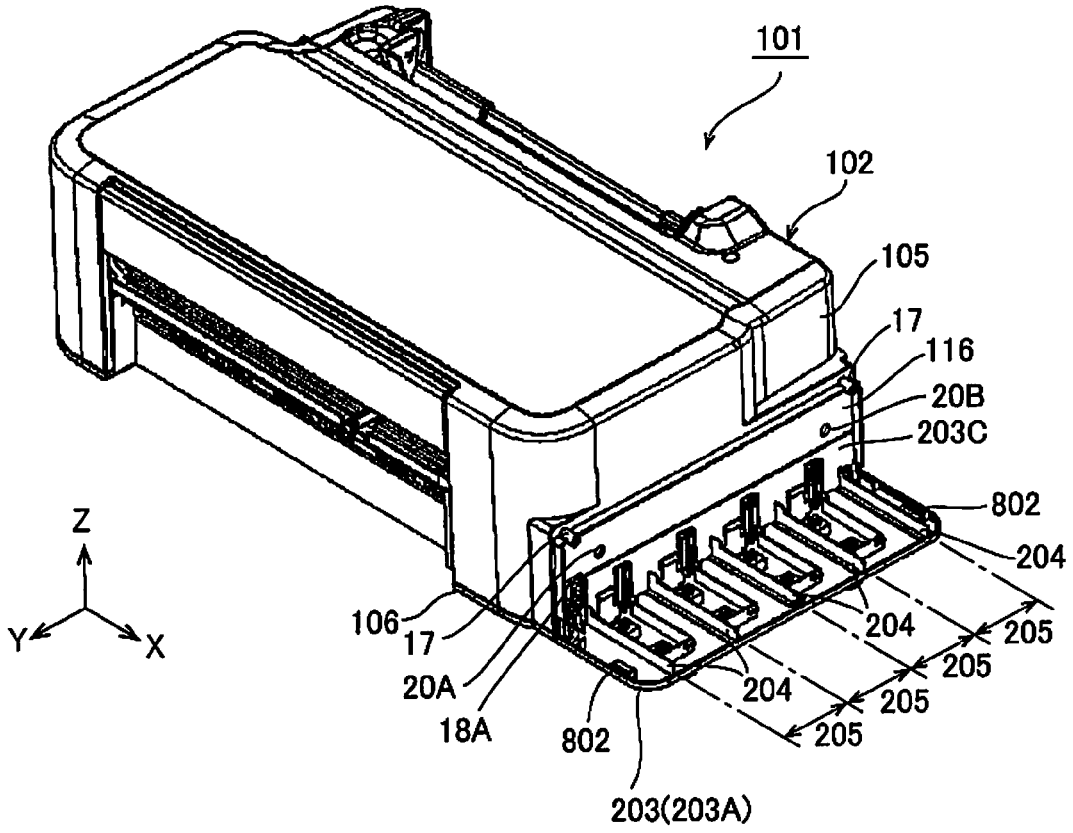
FIG. 16 is a perspective diagram illustrating a liquid ejecting system of the second embodiment in a state where an upper surface cover member and a tank are removed.

FIG. 15 is an exploded perspective diagram of the liquid ejecting apparatus 101 and illustrates a state where the upper surface cover member 7B is removed. In addition, FIG. 16 is a perspective diagram illustrating the liquid ejecting apparatus 101 in a state where the upper surface cover member 7B and the tanks 9 are removed. As shown in FIG. 15, the four window sections 21 are provided in the upper surface cover member 7B in a side surface which faces the +X axis direction and it is possible to visual recognize the tank 9 from the window sections 21. In addition, the four openings 251 are provided an upper surface which faces the +Z axis direction and it is possible introduce ink from here into the tanks 9. The two fixing sections 701 where penetration holes for screw fixing are formed and the two engaging sections 702 which engaged with the base section 106 are provided in the upper surface cover member 7B.

As shown in FIG. 16, the second region 106B of the base section 106 is configured in the same manner as the bottom surface cover member 8B in the first embodiment and modified examples 2 and 3 and is provided with the base section 201 and the partition wall 203 and the partition wall 204 which protrude from the base section 201 in the +Z axis direction. The engaged sections 802 are formed in the base section 201 at positions which respectively overlap with the two engaging sections 702 described above in the Z axis direction. In addition, the four tank arrangement regions 205 which are segmented by the partition walls 204 are provided in the base section 201. On the other hand, the partition wall 203 is provided with the partition wall 203A which is provided along the outer edge in three directions on the +Y axis direction side, the +X axis direction side, and the −Y axis direction side of the base section 201 and the partition wall 203C which is provided along the outer edge on the −X axis direction side of the base section 201.

As shown in FIG. 15 and FIG. 16, an attachment surface 116 with a rectangular shape is provided in the body cover member 105 at a side surface which faces the +X axis direction. The boss sections 17 are provided at each of two location on the +Z axis direction sides out of the four corners of the attachment surface 116. When the upper surface cover member 107 is fixed to the body cover member 105, the upper surface cover member 107 is fixed using the attachment pins 31 by each of the bosses 17 being overlaid with the fixing sections 701. In addition, the cut away section 18A is provided in the attachment section 116. The supply tube 4 is drawn out from the cut away section 18A to the tank 9 side. As shown in FIG. 16, the two penetration holes 20A and 20B are provided in the attachment surface 116. The side frame 106C of the base member 106 is arranged to overlap on the rear surface side (−X axis direction side) of the attachment surface 116. The penetration holes 603A and 603*b* (refer to FIG. 17) are provided in the side frame 106C at positions which overlap with the penetration holes 20A and 20B.

Figure 17A:
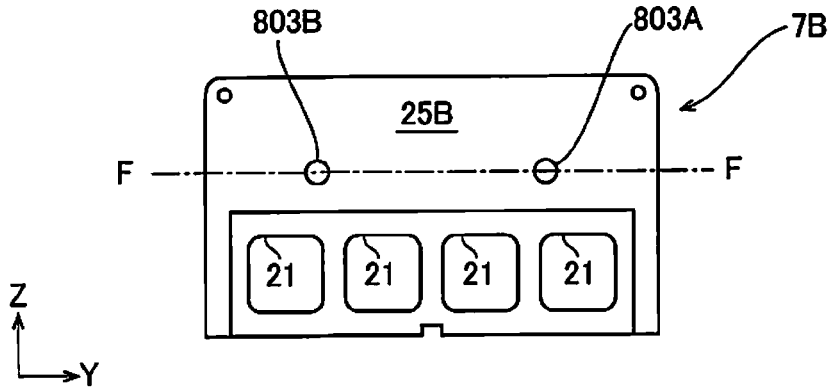
FIGS. 17A to 17C are explanatory diagrams schematically illustrating a coupling section of an upper surface cover member with a body cover member and a base member.
Figure 17B:
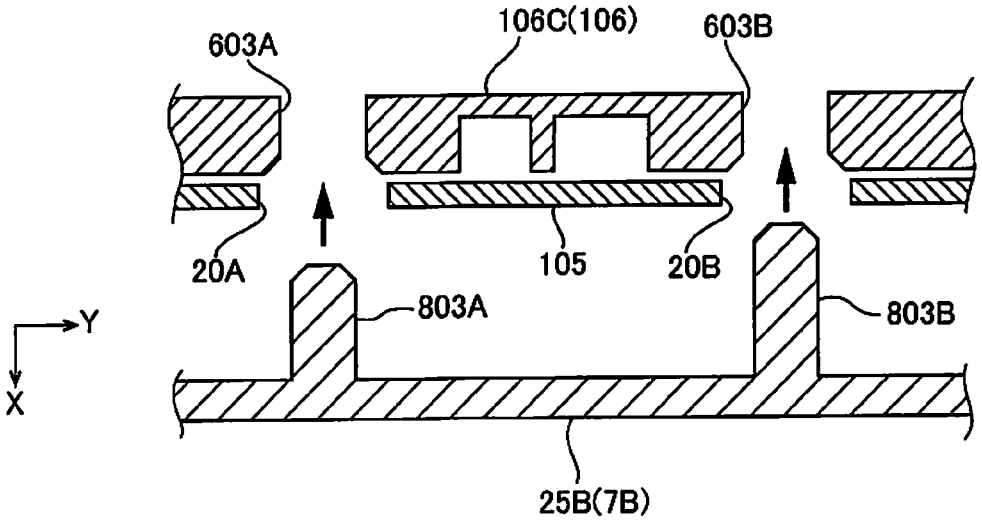
Figure 17C:
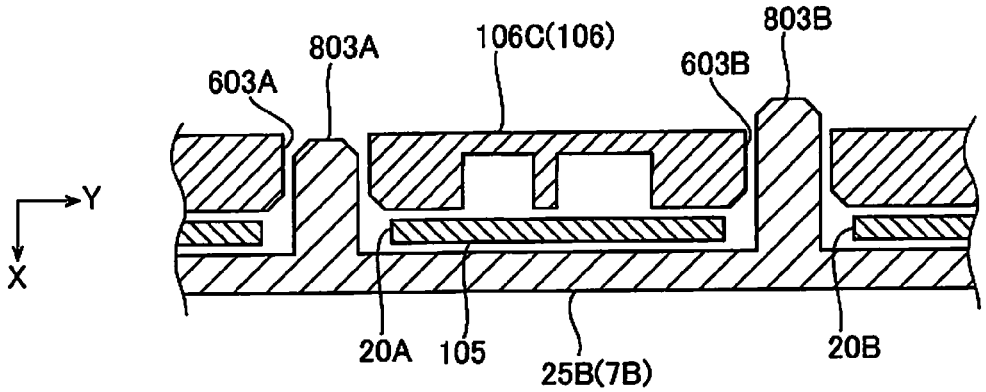

A coupling section of the upper surface cover member 7B and a member on the liquid ejecting section 102 side (the body cover member 105 and the base member 106) is provided in the liquid ejecting apparatus 101 of the second embodiment in the same manner as the first embodiment and modified example 2. FIGS. 17A to 17C are explanatory diagrams schematically illustrating a coupling section of the upper surface cover member 7B and the body cover member 105 and the base member 106. FIG. 17A is a side surface diagram where the upper surface cover member 7B is viewed from the +X axis direction. In addition, FIGS. 17B and 17C are cross sectional configurations of a coupling section which is cut away at the XY plane which includes a line F-F in FIG. 17A, FIG. 17B illustrates a state where the upper surface cover member 7B is removed, and FIG. 17C illustrates a state where the upper surface cover member 7B is fixed to the body cover member 105.

As shown in FIG. 17A, the upper surface cover member 7B is provided with the side wall section 25B which configures the side surface on the −X axis direction side. The protruding sections 803A and 803B which protrude in the −X axis direction are provided in the side wall section 25B. The protruding sections 803A and 803B are provided at positions which overlap with the penetration holes 20A and 20B in the body cover member 105 in the X axis direction. The boss sections 17 and the fixing sections 701 abut when the upper surface cover member 7B is fixed to the body cover member 105, but the protruding section 803A is inserted into the penetration hole 20A and the penetration hole 603A and the protruding section 803B is inserted into the penetration hole 20B and the penetration hole 603B at this time as shown in FIG. 17C. The configurations of the protruding sections 803A and 803B, the penetration holes 20A and 20B, and the penetration holes 603A and 603B are the same as the first embodiment.

As above, the protruding sections 803A and 803B of the upper surface cover member 7B are coupled so as to each penetrate through the body cover member 105 and the body base member 106 in the liquid ejecting apparatus 101 in the second embodiment. Accordingly, it is possible to increase the fixing strength compared with in the past. Here, the number of the coupling sections may be one location or may be three or more locations. In addition, the base section 106, which in integrally provided with the first region 106A which supports the mechanism unit 10 and the second region 106B which supports the four tanks 9, is used as a casing member on the bottom surface side of the liquid ejecting apparatus 101 in the second embodiment. Accordingly, integrity of the casing of the liquid ejecting apparatus 101 is increased and stable carrying is possible. Furthermore, a removing operation is easy since it is sufficient if only the upper surface cover member 7B is removed when there is a desire to remove the ink containing section 103.

Third Embodiment

Figure 18:
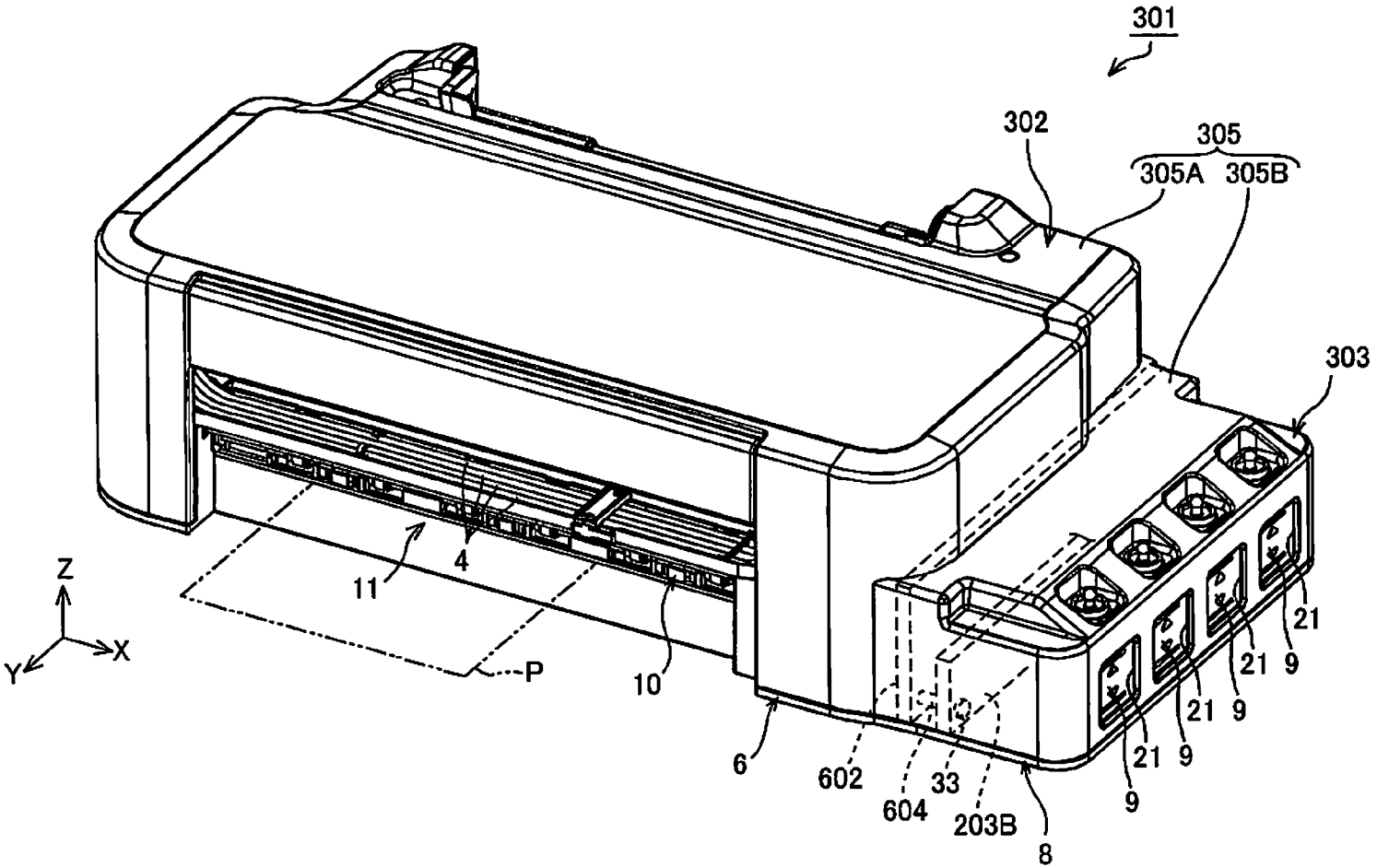
FIG. 18 is a perspective diagram illustrating a liquid ejecting system of a third embodiment.

FIG. 18 is a perspective diagram illustrating a liquid ejecting system according to a third embodiment of the present invention. Portions which are the same as the first and second embodiments are given the same reference numerals, the description thereof is omit, and only portions which are different will be described. As shown in the diagram, a liquid ejecting apparatus 301 of the third embodiment has a liquid ejecting section 302, an ink containing section 303 (the containing section), and the supply tube 4 (the liquid supply tube). An ink jet printer where printing is performed on the printing medium P such as paper sheets using ink which is an example of liquid is shown as an example of the liquid ejecting apparatus 301 in the third embodiment. The ink is supplied from the ink containing section 303 to the liquid ejecting section 302 via the supply tube 4.

The liquid ejecting section 302 includes a cover member 305 (the first casing), a body base member 306 (the second casing) which opposes a first region 305A which is a part on the −X axis direction side of the cover member 305, and the mechanism unit 10 (refer to FIG. 4). The first region 305A is a part on the −X axis direction side of the cover member 305. The mechanism unit 10 is positioned between the first region 305A of the cover member 305 and the body base member 306. The mechanism unit 10 is a mechanism portion which executes printing operations. A paper discharge section 11 is provided in the liquid ejecting section 302 in a front surface which faces the +Y axis direction. The body base member 6 has the same configuration as the first embodiment as will be described later.

The ink containing section 303 includes a second region 305B which is part on the +X axis direction side of the cover member 305, the bottom surface cover member 8 (the third casing) which opposes the second region 305B, and a plurality (two or more) of the tanks 9. The second region 305B is a part on the +X axis direction side of the cover member 305. The plurality of tanks 9 are positioned between the second region 305B of the cover member 305 and the bottom surface cover member 8. Four of the tanks 9 are provided in the third embodiment in the same manner as the first and second embodiments. The bottom surface cover member 8 has the same configuration as in the first embodiment as will be described later.

The mechanism unit 10 is supported by the body base member 6. The mechanism unit 10 is configured in the same manner as the first and second embodiments and has the printing section 41, the medium transporting mechanism 42, and the head moving mechanism 43. The printing section 41 has the carriage 45, the printing head 47 (the liquid ejecting head), and four of the relay units 49. The medium transporting mechanism 42 is provided with the transport motor 51 and a motor which drives the transport motor 51. In addition, the head moving mechanism 43 is provided with the motor 53, the timing belt 55, and the like (refer to FIG. 4).

The body base member 6 has the base frame 601 and the side frame 602 as described in the first embodiment. The boss sections 604 for screw fixing of the bottom surface cover member 8 are provided in the side frame 602. In addition, the penetration holes 603A and 603B are provided in the side frame 602 (refer to FIG. 19). The fixing sections 801 are provided in the bottom surface cover member 8 at positions which overlap with the boss sections 604 as described in the first embodiment (refer to FIG. 3 and the like). Due to this part being screw fastened using the attachment pins 33, the bottom surface cover section 8 is fixed to the body base member 6. The bottom surface cover member 8 is provided with the base section 201, the partition wall 203, and the partition wall 204 (refer to FIG. 7 and the like). The engaged sections 802 are formed at two locations in the base section 201 (refer to FIG. 8 and the like). Engaging sections (which is omitted from the diagram) are formed in the cover member 305 at positions which overlap in the engaged sections 802 in the Z axis direction. The partition wall 203 of the bottom surface cover member 8 is provided with the partition wall 203B which overlaps with the side frame 602 in the X axis direction. The protruding section 803A and 803B are provided in the partition wall 203B at positions which overlap with the penetration holes 603A and 603B in the X axis direction (refer to FIG. 8 and FIG. 19).

Figure 19:
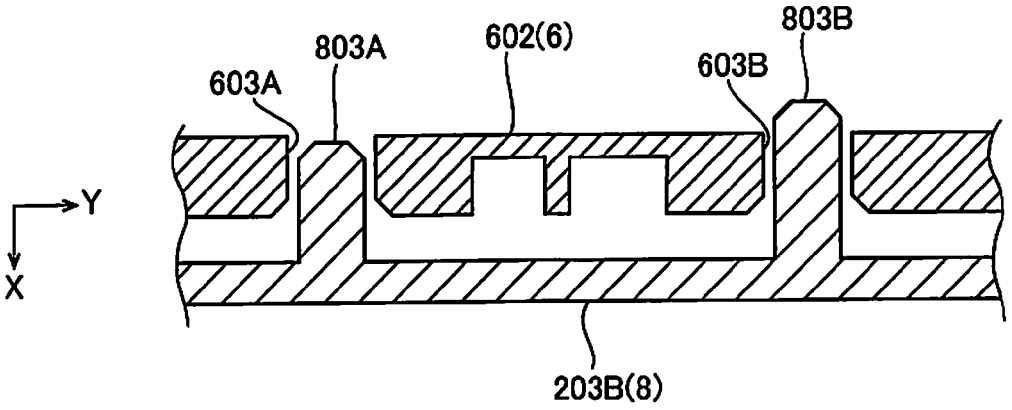
FIG. 19 is an explanatory diagram schematically illustrating a coupling section of a bottom surface cover member and a body base member.

A coupling section of the bottom surface cover member 8 and the body base member 6 is provided in the liquid ejecting apparatus 301 of the third embodiment. FIG. 19 is an explanatory diagram schematically illustrating a coupling section of the body base member 6 and the bottom surface cover member 8 and illustrates a cross sectional configuration when the body base member 6 and the bottom surface cover member 8 are cut away at a XY plane which includes a central axis of the protruding sections 803A and 803B. The protruding section 803A is inserted into the penetration hole 603A and the protruding section 803B is inserted into the penetration hole 603B as shown in FIG. 19 when the body base member 6 and the bottom surface cover member 8 are positionally aligned. The configurations of the penetration holes 603A and 603B and the protruding sections 803A and 803B are the same as the first embodiment.

As above, the protruding sections 803A and 803B of the bottom surface cover member 8 are coupled so as to penetrate through the body base member 6 in the liquid ejecting apparatus 301 in the third embodiment. Accordingly, it is possible to increase the fixing strength compared with in the past. Here, the number of the coupling sections may be one location or may be three or more locations. In addition, the cover member 305 which is integral and covers the mechanism unit 10 and the four tanks 9, is used as a casing member on the upper surface side of the liquid ejecting apparatus 301 in the third embodiment. Accordingly, integrity of the casing of the liquid ejecting apparatus 301 is increased and stable carrying is possible by grasping the cover member 305.

Other Embodiments

A scanner unit may be installed in the first to third embodiments at a part of the cover member which overlaps with regard to the mechanism unit 10 in the +Z axis direction.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid ejecting system comprising:

a liquid ejecting apparatus;

a containing unit configured to contain a liquid; and a liquid supply tube configured to supply the liquid from the containing unit to the liquid ejecting apparatus, wherein the liquid ejecting apparatus includes a first casing, a second casing that opposes the first casing, and a liquid ejecting head that is positioned between the first casing and the second casing and is configured to eject the liquid, the containing unit includes a third casing that has an upper wall section facing in a vertically upward direction in a state where the liquid ejecting apparatus is being used, a fourth casing that opposes the third casing, and a liquid containing vessel that is positioned between the third casing and the fourth casing and is configured to contain the liquid, the first casing has a first penetration hole, the second casing has a second penetration hole that overlaps with the first penetration hole, the fourth casing has a first protruding section, and the containing unit is fixed to the liquid ejecting apparatus in a state where the first protruding section is inserted into the first penetration hole and the second penetration hole.

2. The liquid ejecting system according to claim 1, wherein the first casing has a third penetration hole, the second casing has a fourth penetration hole that overlaps with the third penetration hole, the fourth casing has a second protruding section, and the containing unit is fixed to the liquid ejecting apparatus in a state where the second protruding section is inserted into the third penetration hole and the fourth penetration hole.

3. The liquid ejecting system according to claim 1, wherein the fourth casing has a third protruding section, and the containing unit is fixed to the liquid ejecting apparatus in a state where the third protruding section and the first casing interpose the second casing.

4. The liquid ejecting system according to claim 1, further comprising at least one of a first fixing member that fixes the first casing and the third casing and a second fixing member that fixes the second casing and the fourth casing.

5. The liquid ejecting system according to claim 1, wherein the first casing includes a scanner unit.

* * * * *